US007131550B2

(12) United States Patent
Vilalta et al.

(10) Patent No.: US 7,131,550 B2
(45) Date of Patent: Nov. 7, 2006

(54) FOOD STORAGE CONTAINERS

(75) Inventors: Montserrat Vilalta, Barcelona (ES); Jose Millan, Barcelona (ES); Juan Carlos Coronado, Barcelona (ES); Mariano Penaranda, Barcelona (ES); Antonio Rebordosa, Sant Fruitos de Bages (ES); Sergi Gili, Barcelona (ES); Robert Rafols, Barcelona (ES)

(73) Assignee: Braun GmbH, Krunberg (DE)

( * ) Notice: Subject to any disclaimer, the term of this patent is extended or adjusted under 35 U.S.C. 154(b) by 18 days.

(21) Appl. No.: 10/882,520

(22) Filed: Jul. 1, 2004

(65) Prior Publication Data

US 2005/0061812 A1 Mar. 24, 2005

Related U.S. Application Data

(63) Continuation-in-part of application No. PCT/DE03/03430, filed on Oct. 16, 2003, and a continuation-in-part of application No. 10/457,285, filed on Jun. 9, 2003, now abandoned, which is a continuation-in-part of application No. PCT/EP02/14693, filed on Dec. 21, 2002, and a continuation-in-part of application No. PCT/EP01/13233, filed on Nov. 15, 2001, and a continuation-in-part of application No. PCT/EP01/13148, filed on Nov. 14, 2001.

(30) Foreign Application Priority Data

| | | |
|---|---|---|
| Dec. 8, 2000 | (DE) | 100 60 995 |
| Dec. 8, 2000 | (DE) | 100 60 999 |
| Jul. 9, 2002 | (DE) | 102 30 748 |

(51) Int. Cl.

| | |
|---|---|
| ***B65D 51/16*** | (2006.01) |
| ***G01L 7/08*** | (2006.01) |
| *B65D 31/04* | (2006.01) |

(52) U.S. Cl. ..... 220/231; 220/367.1; 220/254.3; 220/203.05; 220/203.11; 220/212; 215/262; 215/260; 215/230; 206/524.8; 116/270

(58) Field of Classification Search ..... 220/203.01–203.27, 254.3, 231, 789, 367.1, 220/798, 801, 212, 239, 254.1, 257.2, 259.1, 220/316, 745, 720, 721; 116/270, 314, DIG. 8; 215/230, 260, 262, 270, 271, 360; 206/524.8
See application file for complete search history.

(56) References Cited

U.S. PATENT DOCUMENTS

| | | | | |
|---|---|---|---|---|
| 2,130,180 | A * | 9/1938 | Evans | 116/270 |
| 2,634,014 | A * | 4/1953 | Kimber | 215/262 |
| 2,655,894 | A * | 10/1953 | Rabbitt | 116/270 |

(Continued)

FOREIGN PATENT DOCUMENTS

| | | |
|---|---|---|
| CH | 304374 | 3/1955 |

(Continued)

*Primary Examiner*—Nathan J. Newhouse
*Assistant Examiner*—James Smalley
(74) *Attorney, Agent, or Firm*—Fish & Richardson P.C.

(57) ABSTRACT

A lid for a food storage container includes a lid body with a vacuum sense opening and a vent opening extending through the lid body, a releasable cover disposed over the vent opening, and a pressure-indicating protrusion. The cover impedes air flow into the container through the vent opening until the cover is released. The pressure-indicating protrusion, which has a cavity in it, is in hydraulic communication with the container through the vacuum sense opening. The pressure-indicating protrusion contracts toward the vacuum sense opening in response to negative container pressure.

38 Claims, 15 Drawing Sheets

U.S. PATENT DOCUMENTS

| | | | | | |
|---|---|---|---|---|---|
| 3,241,514 | A | * | 3/1966 | Grimland | 116/270 |
| 3,737,066 | A | | 6/1973 | Ames | |
| 4,016,999 | A | | 4/1977 | Denzer | |
| 4,051,971 | A | | 10/1977 | Saleri et al. | |
| 4,674,642 | A | | 6/1987 | Towns et al. | |
| 4,778,072 | A | * | 10/1988 | Newman | 215/253 |
| 4,793,717 | A | | 12/1988 | Manske | |
| 4,838,772 | A | | 6/1989 | LeBlanc | |
| 5,137,424 | A | | 8/1992 | Daniel | |
| 5,195,427 | A | | 3/1993 | Germano | |
| 5,277,876 | A | * | 1/1994 | Wagner | 422/110 |
| 5,279,550 | A | * | 1/1994 | Habib et al. | 604/38 |
| 5,465,857 | A | * | 11/1995 | Yang | 215/228 |
| 5,735,317 | A | | 4/1998 | Wu | |
| 5,762,228 | A | * | 6/1998 | Morgan et al. | 220/367.1 |
| 5,779,082 | A | | 7/1998 | Miramon | |
| 5,803,282 | A | * | 9/1998 | Chen et al. | 215/228 |
| 5,806,703 | A | * | 9/1998 | Grandi | 220/203.15 |
| 5,955,127 | A | * | 9/1999 | Glaser | 426/106 |
| 5,974,686 | A | | 11/1999 | Nomura et al. | |
| 6,799,506 | B1 | | 10/2004 | Tarlow | |
| 2004/0173105 | A1 | | 9/2004 | Kim et al. | |

FOREIGN PATENT DOCUMENTS

| | | |
|---|---|---|
| DE | 74 09 380 | 3/1974 |
| DE | 28 21 852 | 5/1978 |
| DE | 83 2 1236 | 7/1983 |
| DE | 41 36 150 | 11/1991 |
| DE | 43 06 171 | 9/1993 |
| DE | 43 34 250 | 10/1993 |
| DE | 43 42 394 | 12/1993 |
| DE | 195 04 638 | 2/1995 |
| DE | 299 20 316 | 11/1999 |
| DE | 10 060 998 | 12/2000 |
| DE | 10 060 999 | 12/2000 |
| EP | 0 234 607 | 9/1987 |
| EP | 0 644 128 | 2/1994 |
| EP | 0 633 196 | 4/1994 |
| EP | 0 820 939 | 1/1998 |
| FR | 2 235 064 | 6/1973 |
| FR | 2 692 870 | 6/1992 |
| GB | 2 317 882 | 4/1998 |
| JP | 07277374 | 10/1995 |
| RU | 2 089 087 | 9/1997 |
| RU | 2089087 | 9/1997 |
| WO | WO88/00560 | 1/1988 |
| WO | WO91/08151 | 6/1991 |
| WO | WO97/17259 | 5/1997 |
| WO | WO02/46057 | 6/2002 |

* cited by examiner

FOOD STORAGE CONTAINERS

CROSS-REFERENCE TO RELATED APPLICATIONS

This application is a continuation-in-part of PCT application PCT/DE03/03430, filed on Oct. 16, 2003, and of U.S. patent application Ser. No. 10/457,285, now abandoned, filed on Jun. 9, 2003, and entitled "Food Storage Containers", which is a continuation-in-part of PCT applications PCT/EP01/13148, filed on Nov. 14, 2001, PCT/EP01/13233, filed on Nov. 15, 2001, and PCT/EP02/14693, filed on Dec. 21, 2002, and which claims priority under 35 U.S.C. § 119(*a*) from German patent applications DE 100 60 999.6 and DE 100 60 995.3, both filed on Dec. 8, 2000, and from German patent application DE 102 30 748, filed on Jul. 9, 2002. The entire contents of all of the above cross-referenced applications are herein incorporated by reference.

TECHNICAL FIELD

This invention relates to sealable food storage containers.

BACKGROUND

Food storage can be improved by keeping food in a container under vacuum. Keeping the food in a container under vacuum helps to protect the food from certain microorganisms and pests, as well as mold and fungus growth. Furthermore, it helps prevent the food from oxidizing, thereby maintaining the moisture level and aroma of the food. However, with systems of this type it is often difficult to open the storage container because the vacuum inside the container draws on the container lid. In addition, it is often not possible for the user to recognize whether the desired vacuum is still present in the storage container. Furthermore, it can be difficult to maintain an adequate vacuum in the storage container, particularly over a prolonged period of time.

Food storage container lids with venting or aerating valves for pressure equalization during heating in a microwave oven are known. For example, EP 0 633 196 A2 describes a mechanism of this type. The venting or aerating valves can be used to prevent the build-up of overpressure in the interior of a food storage container when it is heated. Such a build-up of overpressure typically occurs when there are aqueous liquids in the interior of the container, and the liquids evaporate during heating, thereby building up an overpressure in the container interior. The result can be that sauces or other food within the container can spurt out suddenly when the container lid is opened. EP 0 633 196 A2 proposes a venting valve in the lid of the food storage container. The venting valve is to be opened before the container is placed in a microwave oven. The water vapor which develops during heating can then escape unhindered through the valve, without a corresponding build-up of vapor pressure in the interior of the sealed container. It is not intended to achieve thereby the improved storage of food under vacuum, or the indication of the pressure level in the food storage container.

In EP 0 820 939 A1, the object is to provide a food storage container with venting capability, so that food stored inside the container can be safely heated in a microwave oven with the container lid closed. Unlike EP 0 633 196 A2, a valve mechanism is described which can be opened by way of a joint like a rocker. Hence all that is required is to press in the rocker lever for the valve to open with ease. Here, too, there is no intention to use the valve mechanism to improve the storage of food under vacuum or to indicate the pressure level in the food storage container.

EP 0 644 128 A1 describes a food storage container having a container lid with a recess in which several vent openings are formed. The vent openings are closed by a seal when a vacuum exists in the holding space. The seal has pin-shaped anchor bars which project upwardly a small amount out of the recess and grow thicker at their ends. These anchor bars serve to lift the seal off the vent openings when air is to enter the holding space of the storage container from outside. Relatively high manual forces need to be applied to open this valve.

EP 0 644 128 A1 also describes a system for evacuating a container closable by a cover. EP 0 644 128 A1 describes a container with a cover that can be used to close the container and that includes a non-return valve located at the bottom of a depression. The annular periphery of the depression forms a sealing surface adapted to sealingly engage with a manually operable vacuum pump.

In accordance with FIG. 5 of EP 0 644 128 A1, if air is evacuated from the container space via the vacuum pump, then the non-return valve opens, and air flows from the container space through the valve into the vacuum pump. During the next idle stroke, after a non-return valve in the vacuum pump is closed, the air is transported outward to the atmosphere. The non-return valve in the cover closes as soon as the pressure in the container space is less than either the pressure in the vacuum pump or the atmospheric pressure. However, the non-return valve in the cover is also closed in the presence of atmospheric pressure in the container space as well as in the environment. The non-return valve opens as soon as the pressure in the vacuum pump is less than the pressure in the container space.

The non-return valve in the cover is formed by a diaphragm that is elastically pre-stressed in its initial position so that the diaphragm blocks the flow path when the diaphragm is in the rest state. If there is a sufficient vacuum in the container space, which is evidenced by the pump becoming increasingly difficult to operate, then an operator can separate the suction connection of the vacuum pump from the suction connection in the cover. This is possible because after every stroke of the vacuum pump, the non-return valve closes again so that no appreciable suction action results at the coupling connection.

In this manner, food that is located in the container space may be preserved longer than would be the case under atmospheric pressure. In the evacuated state, the cover can no longer be separated from the container because the force on the sealing surface between the cover and container is too great, due to the existing pressure difference. As a result, in order to subsequently open the container to remove the food, the vacuum in the container space must first be removed. This is achieved by manually pulling on a pin formed on the sealing sleeve until the sealing surface of the valve lifts away from the valve seat. Accompanied by hissing noises, atmospheric air is now able to flow into the container space until the pressure in the atmosphere and the pressure container space are equalized. After the pressure has been equalized, the cover can be easily removed from the container, and food can be removed from the container.

The arrangement described in EP 0 644 128 A1 can result in different vacuum pressures being produced in the container space via the manually operated vacuum pump, depending on the force exerted by an operator, and on the number of strokes that are completed at the vacuum pump. If in this process the vacuum becomes too strong in the container space, then bacteria that can attack the food can form in the container space. In fact, practice has shown that optimal storage life values may only be achieved within a certain pressure range in the container space. The arrangement described in EP 0 644 128 A1 can also result in other media (e.g. water) being transported by the vacuum pump, which can contaminate the food.

WO 88/00560 describes an opening mechanism for a plastic beverage can, and allows for a kind of visual check of pressure level. The beverage can has a plastic lid (the lids involved tend to be plastic, since one object is to avoid using metal lids) which bulges outward when the pressure inside the container is above atmospheric pressure. Such an arrangement does not allow for any quantitative conclusions about the magnitude of the pressure above atmospheric inside the container. Pressure equalization can occur by opening a venting valve, making it easier to subsequently remove the entire lid. The equalization of overpressure in the container interior (as a result of carbonated beverages, for example) plays a role in this case. This opening mechanism does not, however, allow for re-closure and the corresponding build-up of pressure.

CH 304 374 discloses a closure lid for an aluminum sterilizing container. The lid has an essentially circular-ring-shaped configuration, and is mounted on a cylindrical aluminum container. A rubber seal is placed between the edge of the lid and the upper brim of the container. In the middle of the container lid there is an additional opening which is covered by a rubber cap. The rubber cap provides a visual check, indicating whether there is a vacuum inside the container. As long as the pressure inside the container is adequately below atmospheric pressure, the rubber cap bulges inward a corresponding amount. This bulge diminishes continually as the vacuum decreases. Hence it is difficult for the observer to decide whether the pressure level inside the container is adequate for ensuring the freshness of the food inside the container.

DE 100 60 999 C1 describes a food storage container including a container lid with an opening mechanism for ventilating the evacuated container before it is opened. According to one embodiment, a sealing tongue is raised up from a vent via a driver. The sealing membrane and a pressure indicator are fastened directly on the container lid. The opening tab is connected non-releasably to the container lid via a film hinge. This mechanism provides an improved possibility for storing food under vacuum. The opening of the lid is facilitated by prior ventilation and the pressure indicator indicates the state of pressure in the container interior. However, disadvantages of this mechanism include the costly installation of the sealing components directly on the container lid, and the complicated driver mechanism of the one-way valve, which is susceptible to defects. Furthermore, the possibility of exchanging the valve mechanism is limited.

Finally, U.S. Pat. No. 5,195,427 describes another container evacuation system. U.S. Pat. No. 5,195,427 describes a vacuum container for storing food that is sealable in an airtight manner by a cover. A valve formed in a flow channel and functioning as a non-return valve is also located in the cover, as already described. The difference with respect to the previously described related art is essentially only that an electric vacuum pump held in the hand of an operator is used in the system, instead of a manually operated vacuum pump. To evacuate the container space, the pump is positioned or coupled in a sealing manner at the suction opening of the cover. The container evacuation system described in U.S. Pat. No. 5,195,427 can result in, as described above, an undesirably high vacuum being created in the container space. In some cases, an undesirably high vacuum can adversely affect the storage life of food in the container. The vacuum pump described in U.S. Pat. No. 5,195,427 can also transport liquid food, for example, when the suction connection is submerged in water, cream, etc., and is then activated.

SUMMARY

In one aspect, the invention features a lid for a food storage container. The lid includes a lid body with a vacuum sense opening and a vent opening extending through it. The lid also includes a releasable cover that is disposed over the vent opening. The releasable cover impedes air flow into the container through the vent opening until the cover is released. The lid further includes a pressure-indicating protrusion that is in hydraulic communication with the container through the vacuum sense opening. The pressure-indicating protrusion has a cavity in it. In response to negative container pressure, the pressure-indicating protrusion contracts toward the vacuum sense opening.

In another aspect, the invention features a lid for a food storage container. The lid has a lid body with a vent opening in it, and a releasable cover disposed over the vent opening. The releasable cover impedes air flow into the container through the vent opening until the cover is released. The releasable cover has an evacuation opening. The lid also includes a membrane that covers the vent opening until the cover is released. The lid further has a driving element that is connected to the membrane at one end and disposed within the evacuation opening at another end.

Embodiments can include one or more of the following features and/or advantages.

The pressure-indicating protrusion can be a dome (it can be dome-shaped). The pressure-indicating protrusion can include a bellows that is sealed at one end by a pressure-indicating plug. The pressure-indicating protrusion can include a membrane. The membrane can be formed of a plastic resin (e.g., an elastomeric plastic). The plastic resin can be selected to maintain dimensional stability of the membrane over a temperature range between about −40° C. and about 100° C. An advantage to this embodiment is that it can allow the storage container and its contents to be stored in a freezer and later to be defrosted in a microwave oven. The membrane can collapse and/or fold toward the vacuum sense opening in response to negative container pressure. The membrane can be pleated. The pressure-indicating protrusion can further include a pressure-indicating plug at one end of the membrane. The pressure-indicating plug can be of a different color from the cover.

The lid can further include a resilient layer that is in contact with the membrane. The resilient layer can include a spring sheet and/or an elastomeric polymer. The resilient layer can be formed, for example, by selecting a suitable resilient plastic material for the membrane of the pressure-indicating protrusion or by inserting a spring metal in the membrane of the pressure-indicating protrusion. An advantage of using a resilient material or a spring metal in the membrane of the pressure-indicating protrusion is that when the interior of the storage container is at ambient pressure, the membrane can project distinctly outward.

The membrane can be a sealing tab. The membrane can act as a one-way valve. The membrane can be constructed as a rectangular plastic strip, for example, with one narrow side connected to the container lid body or an elastomeric plastic layer attached thereto. This fastening edge can act as an elastic joint. During the evacuation operation the membrane can be swiveled upward from the vent opening by the suction effect of the suction device, i.e., the membrane can be lifted clear of the vent opening, enabling air present in the storage container to be drawn off by the suction device. Once the storage container is evacuated, sealing can take place automatically by the membrane being drawn against the vent opening in the lid body.

The visual impact of the pressure indicating protrusion, which can be made of an elastomeric plastic material, can be increased by, for example, designing the pressure indicating protrusion (e.g., the membrane of the pressure indicating protrusion) in an easily visible color (e.g., that is different in color from the cover and/or from the container). Such an embodiment can allow for particularly easy viewing of the pressure indicating protrusion, as well as a clear indication of the pressure in the food storage container.

The pressure-indicating protrusion can enable even users with poor vision to determine the condition of pressure inside a storage container through tactile means (e.g., by determining the degree to which the pressure indicating protrusion projects beyond, or disappears within, the outer contour of the cover).

The pressure-indicating protrusion can include a spring. The stiffness of the spring can be set or selected retrospectively to the desired response pressure (i.e. to the value of the container pressure at which the pressure-indicating protrusion is triggered). The pressure-indicating protrusion can include a resilient material. An advantage to such a pressure-indicating protrusion is that it can have a low number of required components and it can be simply installed.

The pressure-indicating protrusion can be capable of indicating two discrete states: (1) the interior of the storage container being at a pressure that is sufficiently below atmospheric pressure, and (2) the interior of the storage container being at a pressure that is insufficiently below atmospheric pressure. An advantage of this embodiment is that the pressure-indicating protrusion can adopt an unmistakable signal position. In other words, if a pre-defined pressure below atmospheric pressure is attained inside the container, then the membrane can "snap" inward. In some embodiments (e.g., in certain embodiments in which the membrane includes a spring), the membrane can be guaranteed to snap back into its initial position when a minimum pressure below atmospheric is exceeded inside the storage container. In such embodiments, the pressure-indicating protrusion can have only two unmistakable positions: sufficient pressure below atmospheric inside the storage container (the pressure-indicating protrusion is snapped inward), and insufficient pressure below atmospheric or ambient pressure (the pressure-indicating protrusion is in its initial position).

The pressure-indicating protrusion can have an essentially cup-shaped configuration with a planar top adjoined by a conically widening annular wall. Such an embodiment of the pressure-indicating protrusion can allow for a clear indication of good or poor vacuum in the container interior. It can avoid a gradual shifting motion by the pressure-indicating protrusion. The annular wall can be slightly outwardly domed, which can allow the pressure-indicating protrusion to be folded together with particularly little friction. There can be no notable rubbing of the side wall when the pressure-indicating protrusion is rolled together.

The lid body can further include a pressure indicator (e.g., a pressure-indicating protrusion). The lid body can be of a plastic resin (e.g., polypropylene, polyamide, and/or other temperature- and aging-resistant plastic materials) that is selected to maintain dimensional stability of the membrane over a temperature range of between −40° C. and 100° C. In such embodiments, it can be possible for the storage container and its contents to be stored in a deep-freezer and then to be defrosted in a microwave oven. The vent opening can be opened by way of the cover for heating in a microwave oven. Possible materials are polypropylene and polyamide as well as any other temperature-and aging-resistant plastic material.

The lid can have the advantage of being easy and economical to manufacture. The lid can be opened relatively easily. For example, in embodiments in which the lid includes a driving element, the membrane, which simply rests on the vent opening, can be lifted off the vent opening by pulling open the cover by way of the driving element. This operation can be comfortably performed without any particular effort because of the leverage between the cover, the driving element and the sealing tab. This can result in pressure equalization between the interior of the container and the surroundings. The container lid is no longer drawn by the vacuum in the interior of the storage container and can be lifted off it with ease. It is also possible for the opening assembly to be positioned in the upper area of the outer wall of the container, above its maximum filling level, such that no food is sucked into the vacuum pump when air is evacuated from the storage container.

The cover can also have an indicator opening. Under certain pressure conditions, the membrane can extend through the indicator opening. Under certain pressure conditions, the pressure-indicating plug can extend through the indicator opening. A benefit to this embodiment is that the pressure indicating protrusion can penetrate the indicator opening as soon as the vacuum in the container interior is inadequate (without penetrating the indicator opening when there is sufficient vacuum in the container interior).

The cover can be produced by an injection molding process. The cover can have a surface that extends about the evacuation opening and that is adapted to receive a sealing lip of a vacuum pump. The cover can be pivotably connected to the lid body by a hinge. The hinge can be formed integrally on, for example, the lid body. The cover can be integrally connected to the lid body by the hinge. The hinge can be of a material with inherent spring characteristics, which can enable the hinge simply to be snapped into a hinge holder fitted, for example, to the lid body. The container lid body and the cover can be manufactured as a joint injection molding. For the membrane and the pressure indicator, it is possible to use an elastomeric plastic or rubber material, which can then be inserted with a sealing effect in the component made up of the container lid body and the cover.

The lid can be universally used with different food storage containers. If the vent assembly is positioned on the container, then the outer surface of the cover adjacent the evacuating opening preferably faces at an angle in an upward direction in order to be better able to mount a vacuum pump on the container wall. This can also facilitate the handling of the vent assembly.

The cover can be pressed into a recess of the lid body and can be locked in the recess for the storage state of the storage container. It can thus be easily possible for several storage containers with their storage lids to be stacked on top of each other without the cover projecting in obstructing manner from the upper side of the container lid body. The lid can include a recessed grip such that it can be possible, even if the cover is clipped in place within a recess of the container lid body, for a user to grip in the gap with one finger in order to lift the cover. The grip surface can be oriented at an upward angle, away from the container lid body.

The lid can include a one-way valve. The one-way valve can include a movable sealing tab. The pressure-indicating protrusion can be integrally connected with the one-way valve (e.g., the pressure-indicating protrusion can be integrally connected with the movable sealing tab). In such cases, the integral one-piece construction including the pressure-indicating protrusion and the one-way valve can include a relatively stiff material and/or a material possessing sealing properties. An advantage of this embodiment is that it can be economical to manufacture (e.g., as an injection molding). Furthermore, it can be easily mounted on the storage container.

One or more of the components of the valve device can be provided separately from the food storage container, and/or can be removably fastened to the food storage container. Advantages of such an embodiment can include simple installation during production and/or the repair or exchange of defective components. Furthermore, the components may not need to be assembled in the same place where they are manufactured.

The driving element can have a rim. This can allow for a simple connection of the driving element to the cover without the parts being joined together by way of threaded connections or any other special connecting elements. If the driving element is elastically made of plastic, the rim can be elastically squeezed together and pushed through the evacuation opening in the cover so that subsequently the rim covers the evacuation opening and can no longer slip through the evacuation opening.

The driving element can be integrally connected to the membrane. The driving element can be constructed, for example, as a spigot standing essentially perpendicular on the membrane, with a circumferential edge positioned in its upper area. In this arrangement the driving element can be made of an elastic material.

While certain advantages have been described, implementations of the invention can have other advantages. For example, the pressure indicator and/or the opening and closing mechanism of the storage container can be easy and inexpensive to manufacture. The storage container can be opened without any major effort. In some cases, only the smallest possible forces are needed to cause the membrane to lift off of the vent opening and to reduce the vacuum inside the storage container. Uncontrolled spraying of food out of a vent opening due to overpressure can be minimized. As a result, the likelihood of a user being soiled and/or scalded when using the container can be reduced.

The cover can perform several functions, and thereby save space and cost. In other words, the cover can act as a coupling element for receiving and forming a tight connection with a vacuum pump, as an actuating and opening element for the one-way valve formed together with the membrane and the vent opening, and/or as an impact guard for the container lid.

The pressure-indicating protrusion (e.g., dome) can allow a user to immediately see when there is a sufficient vacuum inside a storage container. The pressure-indicating protrusion can provide a visual and/or tactile signal of the pressure condition inside a storage container. The membrane of the pressure-indicating protrusion can include, for example, an elastomeric plastic material which can be of an easily visible color. The pressure-indicating protrusion can enable a user with poor vision to determine the condition of pressure inside the storage container by means of touch. A lid with a pressure-indicating protrusion can serve as a multi-function component.

The valve device can have the advantage of being simple to fit and having few components. The valve device can be exchanged or fixed (e.g., if a leakage or the like suddenly occurs). The valve device can be multifunctional, simultaneously providing a connection for a vacuum pump, pressure indication, and ventilation.

The details of one or more embodiments of the invention are set forth in the accompanying drawings and the description below. Other features and advantages of the invention will be apparent from the description and drawings, and from the claims.

DETAILED DESCRIPTION

Figure 1:
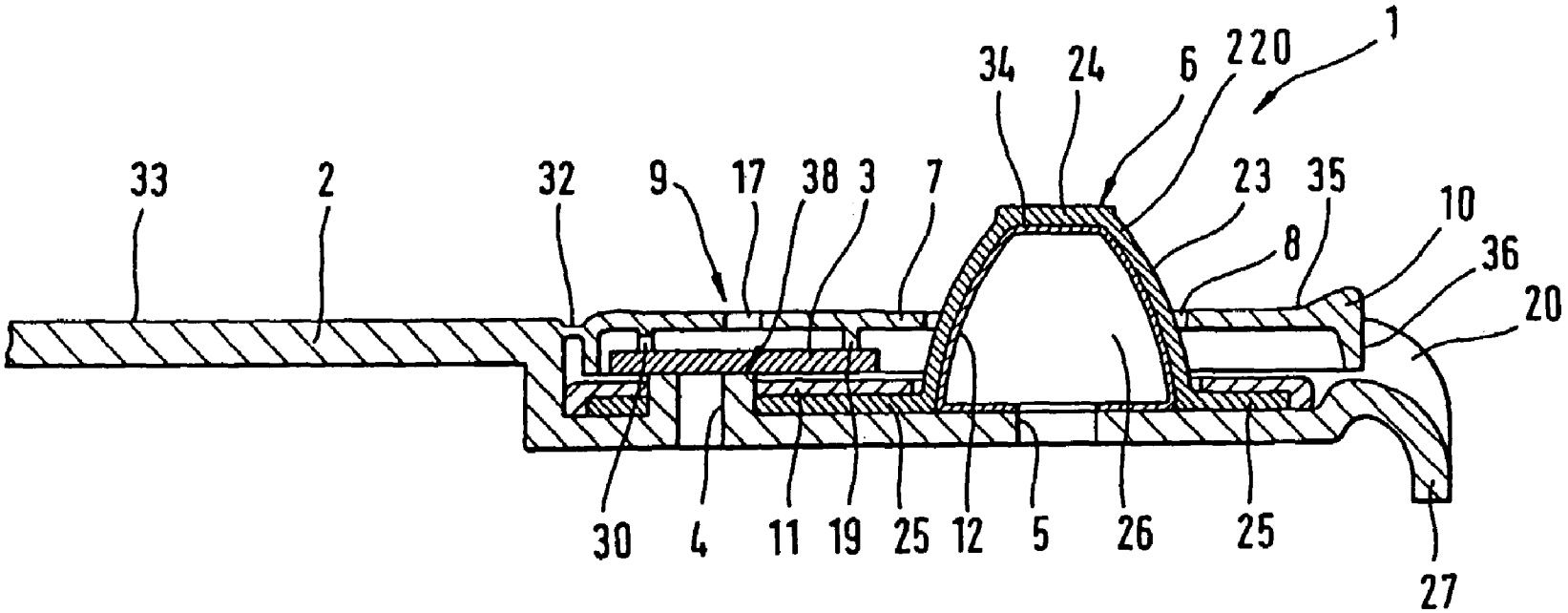
FIG. 1 is a schematic cross-sectional view of a first valve device for a food storage container when there is an insufficient vacuum inside of the container.
Figure 2:
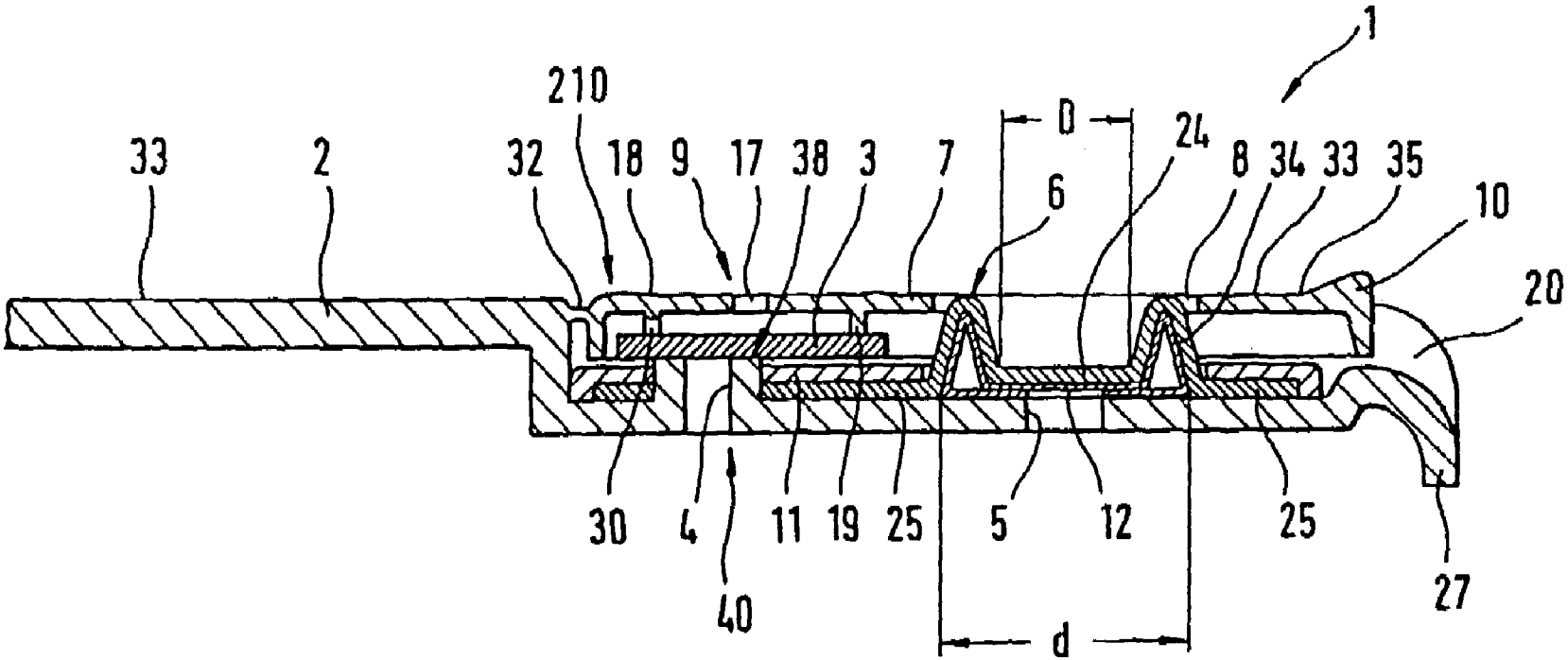
FIG. 2 is a schematic cross-sectional view of the valve device of FIG. 1, when there is a sufficient vacuum inside of the container.
Figure 3:
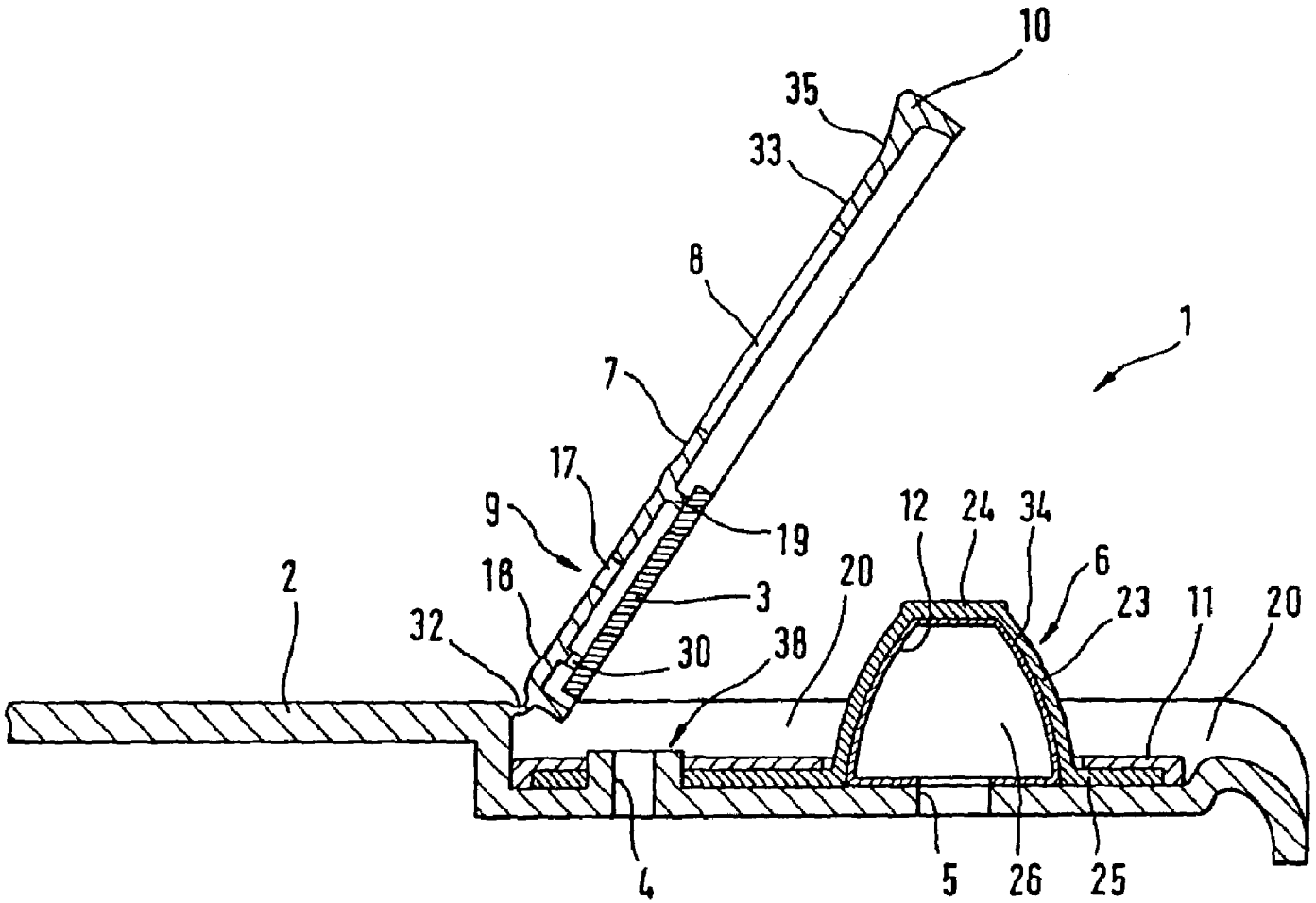
FIG. 3 is a schematic cross-sectional view of the valve device of FIG. 1, when the inside of the storage container is at atmospheric pressure.

Referring to FIGS. 1–3, a valve device 1, which is engageable with a food storage container 15, includes a pressure indicator 6 (a pressure-indicating protrusion).

Referring now to FIGS. 1–6, valve device 1 is mounted on a container lid 2. A cover 7 is integrally connected to container lid 2 by means of a film hinge 32. Cover 7 and container lid 2 are injection moldings made of temperature-resistant thermoplastic material. Cover 7, which in the plan view can be in the form of an oval plate, includes a connecting device 9. Connecting device 9 allows container lid 2 to releasably engage a vacuum pump—i.e., connecting device 9 provides a suction port for a vacuum pump. Connecting device 9 is formed by a smooth annular surface 18 on the outer side 210 of cover 7, and by one or more openings 17 within annular surface 18. A suitable connecting device is described in U.S. Published Patent Application No. US 2004/0040618 A1, published on Mar. 4, 2004, and entitled "Food Storage Containers", the entire contents of which are hereby incorporated by reference.

A sealing tab 3 (of, e.g., elastomeric plastic) is disposed on the lower side of cover 7, underneath connecting device 9. In the valve device 1 shown in FIGS. 1–3, sealing tab 3 is fastened to cover 7 by a circular-ring-shaped bar 19, and is a separate component in the shape of a disk. Bar 19 has an air passage 30.

In FIGS. 1–6, cover 7 is inserted in a recess 20 in container lid 2. Recess 20, which is essentially rectangular, is adapted to conform to cover 7. Container lid 2 includes a vent opening 4 under connecting device 9 of cover 7, and under sealing tab 3. When open, vent opening 4 provides a connection between the atmosphere and the interior 22 of storage container 15. When closed, vent opening 4 is closed air-tight by sealing tab 3. Vent opening 4 and sealing tab 3 together form a one-way valve 40, which closes in the direction of storage container 15.

Figure 4:
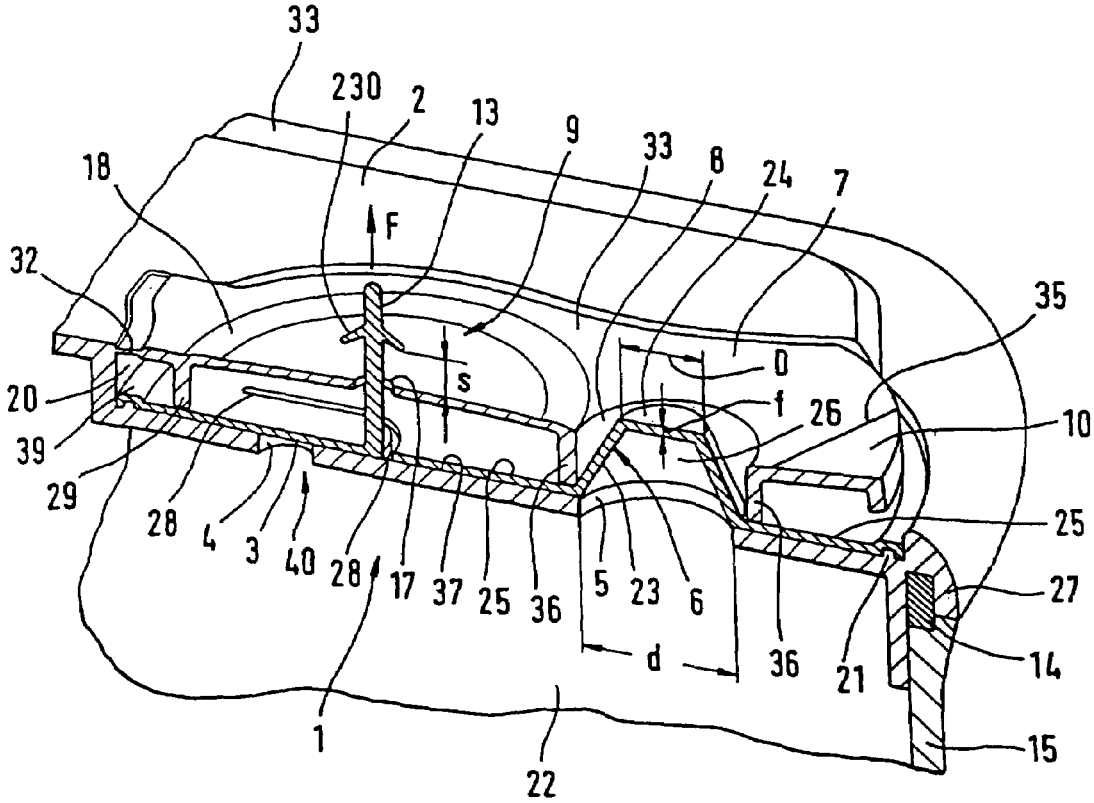
FIG. 4 is a perspective view, partially in cross-section, of a second valve device for a food storage container, when there is an insufficient vacuum inside of the container.

A vacuum sense opening 5 in container lid 2 is arranged adjacent to vent opening 4. Pressure indicator 6 includes a plastic membrane 220 which provides an air-tight covering for vacuum sense opening 5. Pressure indicator 6 extends in an upward direction, essentially perpendicular to the plane of container lid 2. When there is an insufficient vacuum in the container, the entire pressure indicator projects upward relative to the plane of container lid 2. In other words, pressure indicator 6 displays an essentially cup-shaped and slightly outwardly domed side wall 23, which tapers in an upward direction and terminates with a horizontally extending circular base 24, as shown in FIGS. 1 and 3–5. Referring specifically to FIGS. 2 and 4, top 24 has a diameter "D" which is smaller than the diameter "d" of the opening on base 25 of pressure indicator 6. As shown in FIG. 2, side wall 23 of pressure indicator 6 folds into a cavity 26 (FIG. 1) in the pressure indicator when exposed to vacuum.

Referring to FIGS. 1–6, cover 7 includes an indicator opening 8 at the position of pressure indicator 6. When the pressure in interior 22 of storage container 15 is not sufficiently below atmospheric pressure, pressure indicator 6 extends vertically out of indicator opening 8, past the outer surface 33 of cover 7. Pressure indicator 6 can be made of an elastomeric plastic. Preferably, pressure indicator 6 is of an easily visible color, such as red (to, for example, distinguish it from the surrounding material of the lid). In FIGS. 1–3, pressure indicator 6 is reinforced on its inner side by a layer 12 that preferably includes a resilient material, such as a spring sheet or elastomeric plastic. The surface of layer 12 is engaged with the inner side 34 of the pressure indicator 6.

In FIGS. 1–6, the section of cover 7 that is closest to the edge of storage container 15 has a gripping surface 10. For example, as shown in FIGS. 1–6, an end of cover 7 is beveled slightly upward starting at point 35, thereby forming gripping surface 10. Container lid 2 includes a recess 20 with a bottom 37. Cover 7 is separated from bottom 37 of recess 20 by ribs 29 and 36. Thus, gripping surface 10 of cover 7 can be comfortably gripped between a user's finger and thumb (not shown) and pulled open in an upward direction.

FIGS. 1–3 show a retaining clip 11 which presses the elastomeric plastic material of the planar base 25 of pressure indicator 6 against container lid 2. Retaining clip 11 is supported by walls of container lid 2 (not shown). In FIGS. 1–3, cup-shaped pressure indicator 6 is integrally connected to base 25. Thus, when pressure indicator 6 is clamped by retaining clip 11, the pressure indicator effectively is sealed to container lid 2.

Figure 5:
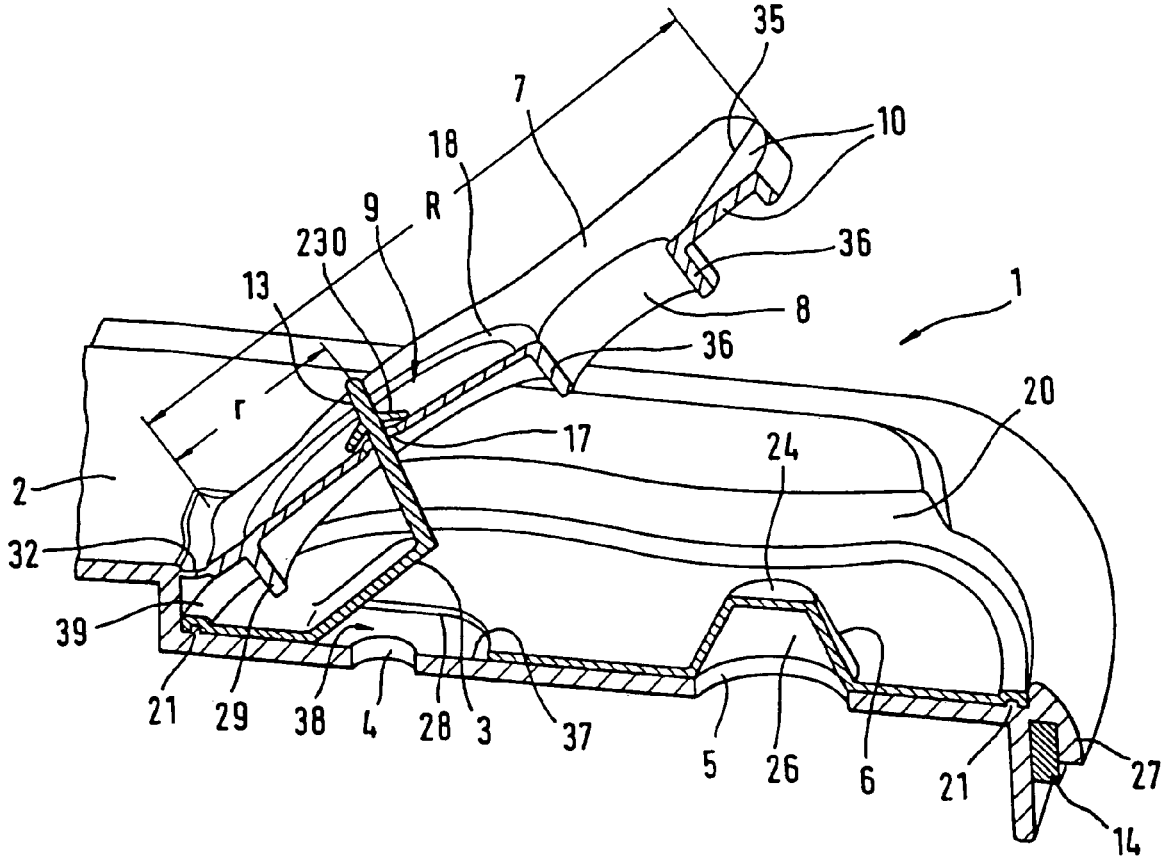
FIG. 5 is a perspective view, partially in cross-section, of the valve device of FIG. 4, when a vent has been opened in the storage container.
Figure 6:
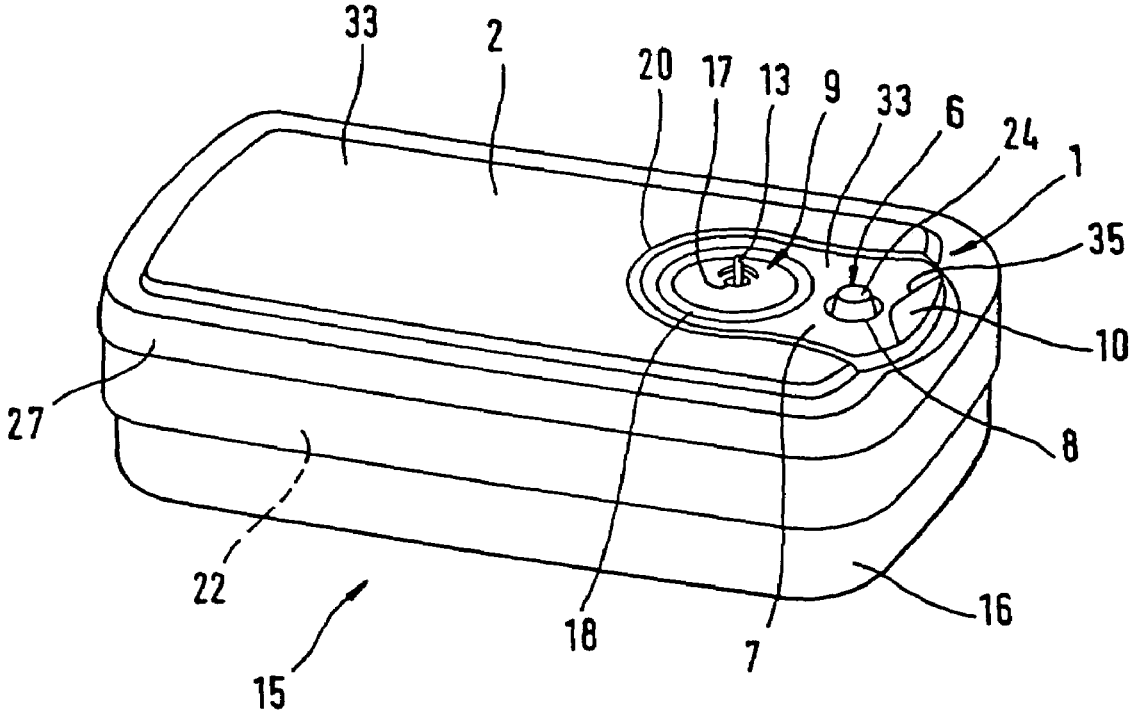
FIG. 6 is a perspective view of a food storage container including the valve device of FIG. 4.

Referring to FIGS. 4–6, a second example of a valve device 1 also includes a pressure indicator 6 for a food storage container 15. In the valve device 1 of FIGS. 4–6, cover 7 is again integrally connected to container lid 2 by means of a film hinge 32. Sealing tab 3 is arranged underneath connecting device 9 of cover 7. Sealing tab 3 is connected to cover 7 by a driving element 13. Sealing tab 3, driving element 13, base 25, and pressure indicator 6 all are made of a single elastomeric plastic part which is fastened as an insert to a bead 21 in recess 20 of container lid 2. The plastic material used for pressure indicator 6 has spring-like properties, such that pressure indicator 6 can snap into a position that indicates whether there is a sufficient vacuum inside the container.

Thus, there are some differences between the valve device 1 of FIGS. 1–3 and the valve device 1 of FIGS. 4–6. In FIGS. 1–3, sealing tab 3 forms a separate sealing part relative to pressure indicator 6. In the valve device 1 of FIGS. 4–6, on the other hand, these parts are formed by a single elastomeric component—sealing tab 3 is partially cut out of base 25, thereby forming a gap 28. Furthermore, in FIGS. 4–5, a circumferential seal 14 is disposed around the edge of container lid 2. Seal 14 enables lid 2 to be closed air-tight against storage container 15. In FIGS. 1–3, on the other hand, lid 2 itself forms a tight closure with storage container 15 (i.e., there is no circumferential seal 14).

Referring back to FIGS. 4–6, when valve device 1 is closed, circumferential rib 29 presses base 25 against the bottom 37 of recess 20, thus effecting a seal. In FIGS. 1–3, base 25 is pressed against container lid 2 by retaining clip 11, which is fitted to lid 2 by latching. In FIGS. 4 and 5, cover 7 performs the same function as retaining clip 11 does in FIGS. 1–3, so that there is no need for a separate retaining clip.

Another difference between the valve device 1 of FIGS. 1–3 and that of FIGS. 4–6 is that the valve device shown in FIGS. 4–6 includes driving element 13, while the valve device shown in FIGS. 1–3 does not.

In FIGS. 1 and 3–6, the pressure in the interior 22 of storage container 15 is equal to ambient pressure. Because of its spring bias, pressure indicator 6 thus projects out through indicator opening 8 and beyond cover 7.

In FIG. 2, there is sufficient vacuum in the interior 22 of storage container 15. Pressure indicator 6 is thus drawn into cavity 26, toward container interior 22. The pressure indicator is in a folded or snapped-in condition. In this state, pressure indicator 6 either does not project at all beyond the outer contour of cover 7, or else projects beyond the outer contour by a negligible amount. Pressure indicator 6 folds like a rolling membrane. The ratio of diameter "D" to diameter "d" is selected based on the wall thickness "f" and the elastic material of pressure indicator 6, so that pressure indicator 6 will abruptly fold together when there is a sufficient vacuum in the interior of the container (as shown in FIG. 2). If the vacuum in container interior 22 decreases, then at the point of insufficient vacuum, pressure indicator 6 will make an abrupt outward movement, snapping back into the position shown in FIGS. 1 and 3–6. Thus, gradual shifting of pressure indicator 6 is avoided, and the user has a clear indication of whether there is a sufficient vacuum in the container.

A user can first inform himself about the pressure status in container interior 22 by checking the position of pressure indicator 6 when container lid 2 is closed. If the bottom of pressure indicator 6 projects out through indicator opening 8, then the pressure in container interior 22 is insufficient for guaranteeing the storage of food under vacuum conditions (as is the case in FIGS. 1, 4, and 6).

In FIGS. 1, 3, and 6, storage container 15 is evacuated. To evacuate the container, a suction port with a circumferential sealing lip of a vacuum pump (not shown) is placed on connecting device 9 of valve device 1. Then, the vacuum pump is put into operation, causing vent opening 4 of valve device 1 to automatically open. Vent opening 4 opens because the suction effect of the vacuum pump causes sealing tab 3 to lift off from vent opening 4, and the air contained in storage container 15 is drawn off by the vacuum pump. In FIG. 1, the air is drawn through vent opening 4, past the side of sealing seat 38 of sealing tab 3, around the outside of sealing tab 3, through air passage 30, and through connecting device 9 to the vacuum pump. As shown in FIG. 2, when a sufficient vacuum is attained in the interior 22 of storage container 15, pressure indicator 6 suddenly snaps inward, thereby informing the user that he can end the evacuation operation. After the vacuum pump is disengaged from connecting device 9, sealing tab 3 is pressed against the edge of vent opening 4, automatically closing it air-tight. This operation also occurs with each return stroke of the vacuum pump, in order to enable a vacuum to be built up in interior 22. The vacuum in interior 22 keeps enclosed food fresh for a long time because lack of oxygen prevents the food from being oxidized.

To remove food from storage container 15, the user grips cover 7 with two fingers under gripping surface 10 and, with little force, swivels cover 7 in a counterclockwise direction (as shown in FIG. 5). Referring to FIG. 3, sealing tab 3 is thus lifted by cover 7 in an upward direction, off sealing seat 38, and vent opening 4 is cleared. In the valve device 1 shown in FIG. 5, the upper side of cover 7 first comes up against the lower side of a rim 230 formed on driving element 13. The upper side of cover 7 then pulls driving element 13 and sealing tab 3 upward, until sealing tab 3 lifts off from sealing seat 38 and swivels upward in a counterclockwise direction. Referring to FIGS. 3 and 5, air can now flow into container 2 via vent opening 4. The distance 5 between rim 230 and the upper side of cover 7 is sufficiently large to prevent the upper side of cover 7 from striking rim 230 until after cover 7 has been released from the latching arrangement (not shown) in recess 20. Such a structure helps to keep the actuating forces low.

Container lid 2 can now be removed from storage container 15 without any notable effort. In FIGS. 4–5, sealing tab 3, which is partially separated from the rest of planar base 25 by gap 28, and which is connected to base 25 only in area 39, repeatedly falls back onto vent opening 4 as a one-way valve acting under the force of gravity. Thus, it is relatively easy to produce a vacuum in the container. It also is conceivable, however, for cover 7 to be designed to snap into place by means of clip connectors on container lid 2, thereby enabling sealing tab 3 to close vent opening 4. The material of sealing tab 4 and base 25 can be elastic enough as to cause vent opening 4 to be closed a result of the closing moment acting on it when there is no difference in pressure. Sealing tab 3 does not lift off vent opening 4 until there is a difference in pressure (i.e., sealing tab 3 works like a one-way valve). Referring to FIG. 3, sealing tab 3 is lifted when cover 7 is swiveled around film hinge 32 because sealing tab 3 is fastened with clearance to cover 7, in order to perform the function of a one-way valve.

Referring to FIG. 6, a thermoplastic food storage container 15 includes valve device 1 from FIG. 4. Storage container 15 has a container body 16 in the shape of a right-parallelepiped and, when viewed from the top, has an essentially rectangular container lid 2 with a circumferential rim 27. Valve device 1 is arranged in a recess 20 on one of the narrow sides of container lid 2. Gripping surface 10 of cover 7 terminates approximately with outer surface 33 of container lid 2. When there is insufficient vacuum inside of the container, only pressure indicator 6 projects vertically out of indicator opening 8 of cover 7.

Adjacent to pressure indicator 6 are connecting device 9 (e.g., a circular connecting device), with smooth annular surface 18, and evacuation hole 17, from which driving element 13 projects with its rim 230. Rim 230 improves the driving effect of driving element 13 when cover 7 is swiveled upward. Through the leverage produced by distances "R" and "r" (shown in FIG. 5), relatively little manual force "F" (shown in FIG. 4) needs to be applied to grip surface 10 and lift sealing tab 3 from sealing seat 38, even when there is still a vacuum in interior 22 of the container. As distance "r" becomes smaller and distance "R" becomes larger, it becomes easier to open valve device 1.

When the valve device is assembled, the upper area of the driving element can be pushed with the rim through evacuation hole 17, with the rim being elastically squeezed together until it has penetrated the evacuation hole from the bottom up. Thereafter, the rim can widen and act as a sort of barb. When cover 7 is swiveled open, driving element 13 is moved upward over the rim in a curved path. The loose end of the sealing tab which is connected to the driving element is thus moved likewise in an upward direction, and lifted clear of the vent opening.

Because of the distance between the lower side of the driving element rim and the upper side of the evacuation hole, the driving element initially slides through the evacuation hole when the cover is swiveled. The rim does not abut and take support upon the upper side of the cover until after the cover has executed a certain swiveling motion about the bearing point, preferably in a counterclockwise direction. From this moment on, the distance between the lower side of the cover and the upper side of the container lid is large enough for several fingers to grip underneath the cover. Thus it is possible, with greater force if at all necessary, to lift the sealing tab off the vent opening by the cover, moving the driving element (and hence the sealing tab) in an upward direction.

The fact that the driving element extends with a clearance in evacuation hole 17 and is also elastically deformable within certain limits means that the swivel movement of the cover on the driving element is deflected in a direction of force extending essentially perpendicular to the sealing surface of the valve opening, with the result that only a small valve opening force is needed to cause the sealing tab to lift off the valve seat of the vent opening and to relieve the vacuum inside the storage container.

The cross-section of the rim of the driving element preferably is dimensioned sufficiently large for the rim to display adequate rigidity, and not to slip through the evacuation hole when the cover is pulled open. It is preferable instead for the rim to rest on the upper side of the cover, and for the sealing tab to reliably lift clear of the vent opening even in the presence of vacuum in the container interior.

Figure 7:
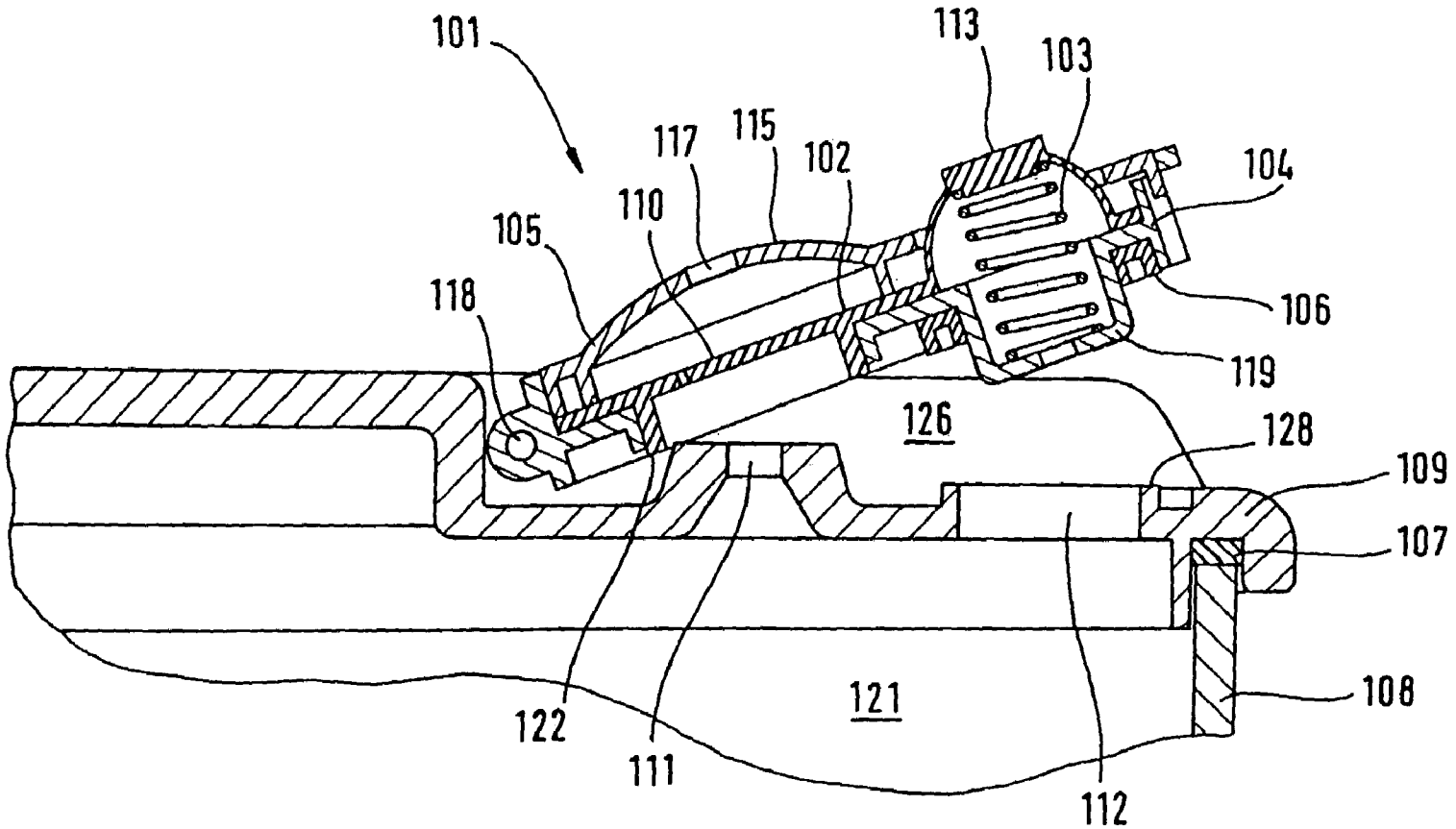
FIG. 7 is a schematic cross-sectional view of a third valve device, in the fitted state.
Figure 8:
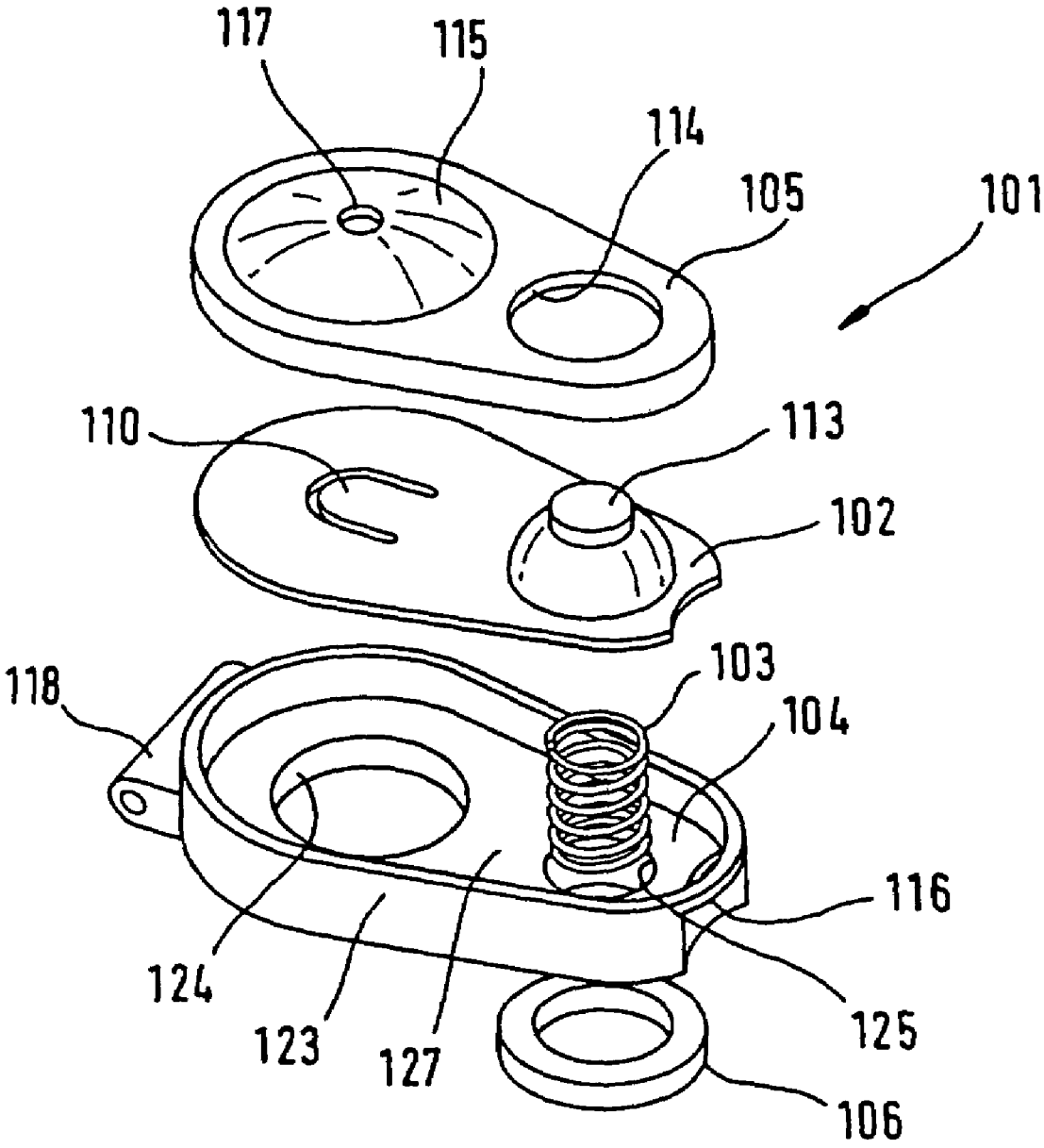
FIG. 8 is a perspective exploded view of the valve device of FIG. 7.

In FIGS. 7 and 8, a first example of a valve device 101 is in the fitted, opened state. Valve device 101 is fitted to a container lid 109 of a storage container 121 for food. Valve device 101 can be used to evacuate air from closed container 121, by means of a connection surface 115 and an extraction opening 117. Valve device 101 can also be used to ventilate evacuated container 121 for easy opening of container lid 109. In addition, the negative pressure in the container is indicated by a pressure indicator 113 integrated in valve device 101.

Container lid 109 sits in the closed state on a container wall 108 of storage container 121 and seals the latter in a gas-tight manner together with a container seal 107, which is designed as an encircling flat seal made from elastomeric plastic. Container lid 109 (which can be produced from thermoplastic) has an elongate depression 126 for holding valve device 101. A measuring opening 112 with a circular cross section and a vent 111 having a likewise circular cross section are provided in depression 126. Vent 111 is fitted to a frustoconical projection.

Valve device 101 has a valve housing 104 that can be produced from thermoplastic. Valve housing 104 has an elongate shape which tapers in one direction and has rounded ends and an encircling edge 123. In this case, a hinge 118 is integrally formed on valve housing 104 at the wider end.

Encircling edge 123 surrounds a planar plastic surface 127 which, in its wider section arranged level with the vent 111, has a first circular cutout 124 concentrically with vent 111. Edge 123, which virtually forms an encircling wall, protrudes vertically above and below plastic surface 127. Furthermore, a second circular cutout 125 is provided in the narrow section of surface 127, i.e. in the region of pressure indicator 113.

Encircling edge 123 provides a boundary and holder for a membrane 102. Encircling edge 123 also serves as a clamping connection for a valve housing cover 105. Valve housing cover 105 is likewise produced from thermoplastic. The valve housing and the valve housing cover can be connected to each other by, e.g., a film hinge. Valve housing cover 105 has essentially the same outer contour as valve housing 104. A connection surface 115 having a lenticular curvature and a central evacuation hole 117 is provided in the region of first cutout 124. A circular indicator opening 114 is fitted in valve housing cover 105, in the region of second cutout 125. Webs which are arranged on the inside of the valve housing cover 105 cause membrane 102 to be pressed against plastic surface 127 of valve housing 104.

Membrane 102 is an essentially sheet-like sealing insert which can be produced from elastomeric plastic (e.g., polybutadiene, butadiene-styrene polymer, acrylonitrile copolymer, poly-chlorobutadiene, isoprene rubber, aftertreated polyolefins, polyurethane, or silicone rubber). In some cases, membrane 102 can be produced from natural rubber or cork. Membrane 102 carries out a plurality of functions simultaneously. First, membrane 102 has, level with vent 111 and evacuation hole 117, a U-shaped incision, what is referred to as sealing tongue 110. Sealing tongue 110 acts as a one-way valve, i.e. sealing tongue 110 raises off from vent 111 during the extraction process undertaken by a vacuum pump (not illustrated) which is fitted to connection surface 115. As soon as the vacuum pump is removed, sealing tongue 110 closes vent 111 because of the negative pressure produced in container 121.

Second, one region of membrane 102 is designed as a pressure indicator 113 which indicates the vacuum state in the container interior. If a sufficient vacuum prevails in storage container 121, the approximately semispherical pressure indicator 113 is pushed in counter to the pressure of a spring 103 in the direction of container 121, virtually in the manner of a concertina. If a limit value is exceeded or if the pressure between the container interior and surroundings is equalized, pressure indicator 113 is pushed out through indicator opening 114 by compression spring 103, which is designed as a helical spring.

Compression spring 103 is held in a spring holder 119 on valve housing 104.

Finally, in the case of the valve device 101 of FIGS. 7 and 8, a sealing ring 106 is provided in the region of second cutout 125, said sealing ring sealing the connection of valve housing 104 to measuring opening 112 in container lid 109.

After storage container 121 has been filled with food, container lid 109 is placed onto container wall 108, which is provided with a container seal 107. Valve device 101 here is closed, i.e. the food is packed in a gas-tight manner. A vacuum pump (not illustrated) is now used to extract the air enclosed in container 121 via evacuation hole 117, sealing tongue 110, and vent 111. So that air is exclusively extracted from container 121, and not from the surroundings, a sealing edge 122 is formed on membrane 102 and seals the frustoconical elevation around vent 111. The reaching of the required minimum negative pressure can be read off using pressure indicator 113. Pressure indicator 113 disappears in indicator opening 114 as soon as the required negative pressure is reached.

When the equalization of pressure occurs over time, the time at which a critical point is reached is indicated by pressure indicator 113. Pressure indicator 113 is designed, if appropriate, to be colored, and protrudes through indicator opening 114. In other words, pressure indicator 113 is pressed beyond indicator opening 114 by the spring force of spring 103. A spring with an appropriate spring stiffness can be installed in pressure indicator 113 to help indicate pressure equalization.

In order to open container lid 109, which is sucked on firmly by the negative pressure of the container, valve device 101 is grasped at handle 116 and pivoted about hinge 118. This causes sealing tongue 110 to be lifted off from vent 111, and sealing ring 106 to be lifted off from sealing seat 128. Thus, storage container 121 is ventilated. After ventilation, container lid 109 can easily be lifted off from container 121.

Figure 9:
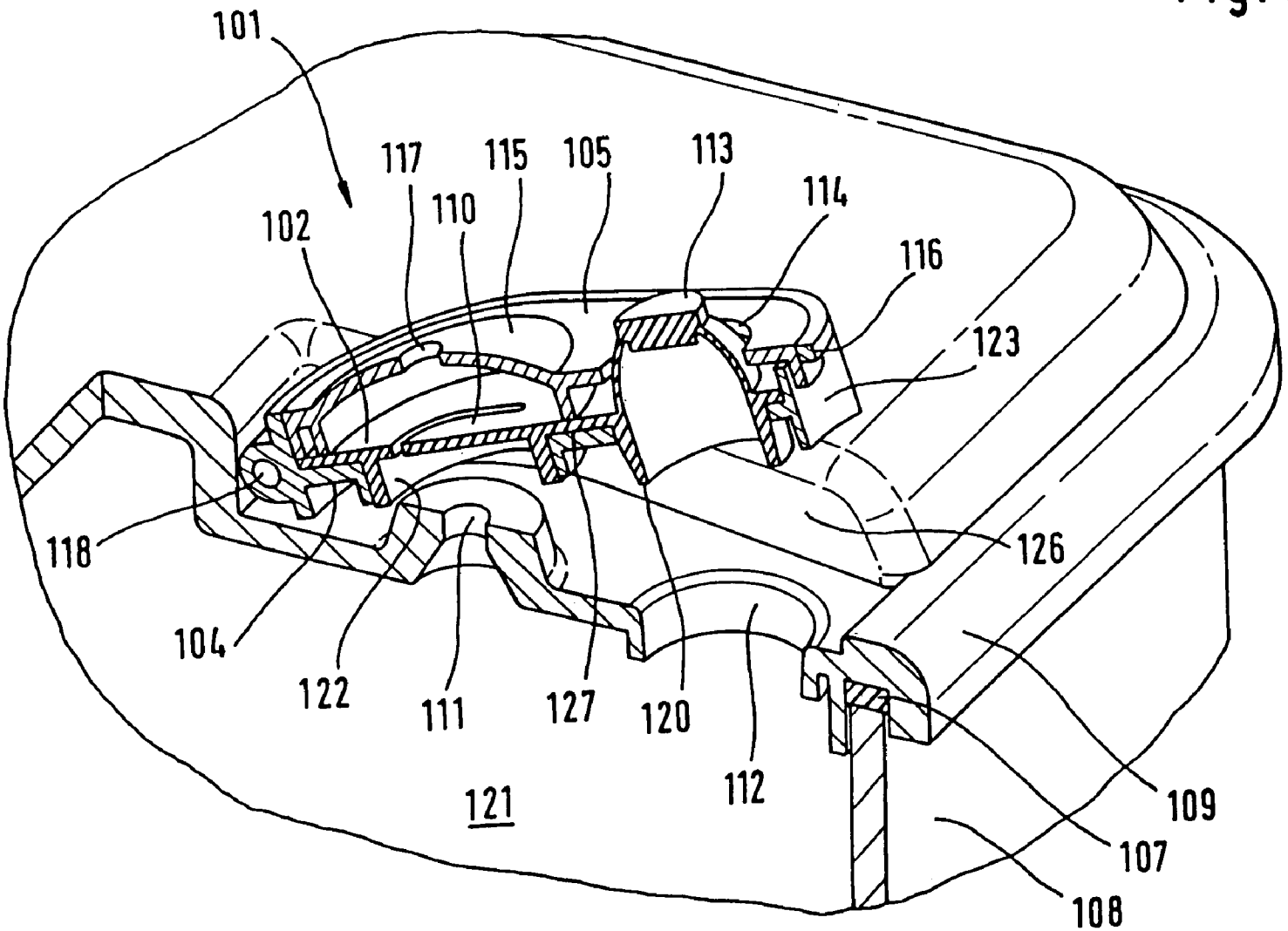
FIG. 9 is a perspective view of a fourth valve device, in the fitted state.
Figure 10:
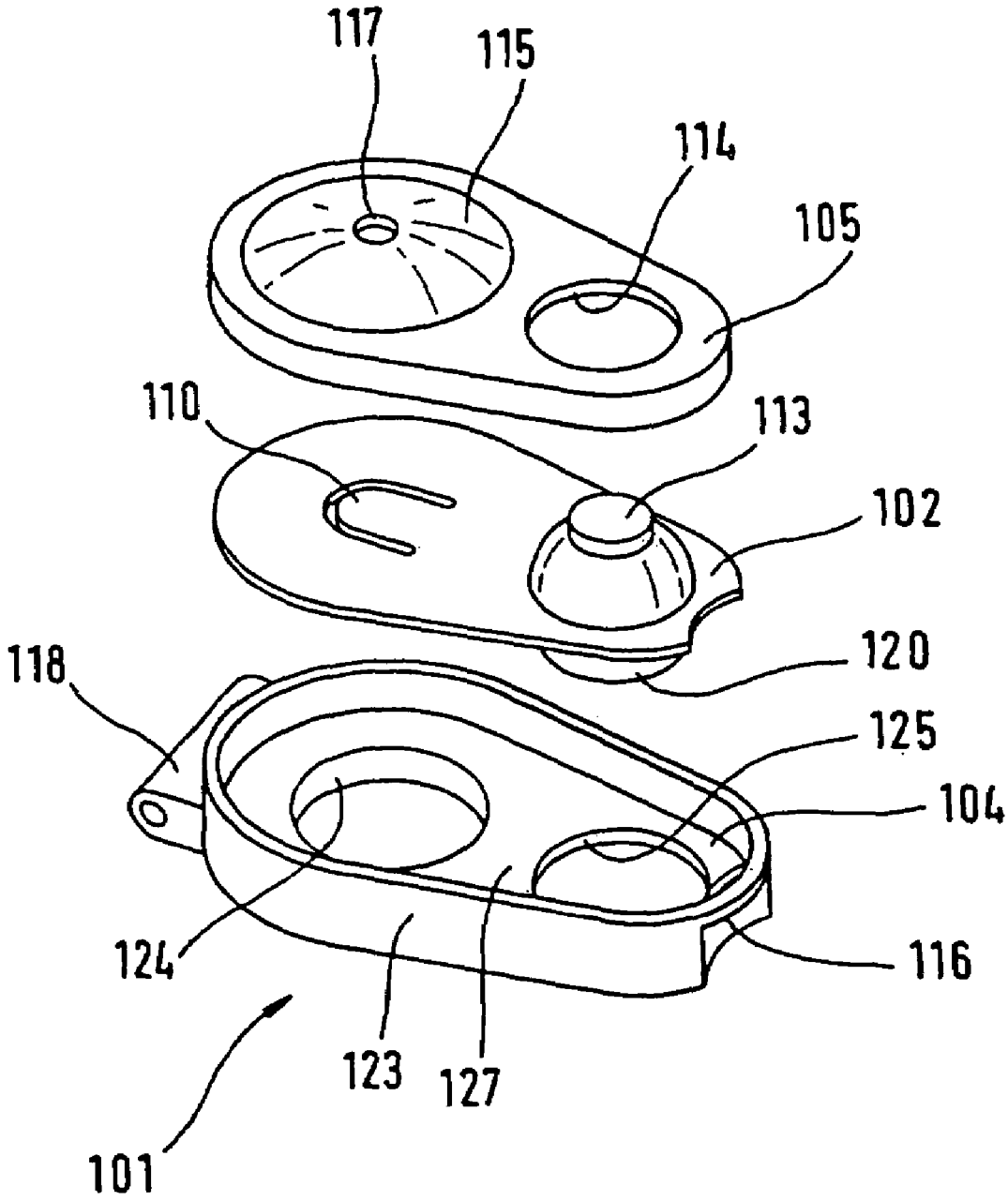
FIG. 10 is a perspective exploded view of the valve device from FIG. 9.

Referring now to FIGS. 9 and 10, a second example of a valve device 101 in the fitted state has essentially three components: valve housing 104, valve housing cover 105, and membrane 102. Such a structure is possible in particular by the changed design of pressure indicator 113, which is produced from a material having inherent spring stiffness. This renders superfluous the compression spring provided in the first example of the valve device. In addition, the integration of a sealing lip 121 on the lower edge of pressure indicator 113 saves an additional sealing ring for sealing the measuring opening 112. Otherwise, the construction and the function of the second valve device 101 correspond to that described with reference to FIGS. 7 and 8.

FIGS. 11–18 show another embodiment of a food storage container, as well as an embodiment of a vacuum pump.

Figure 11:
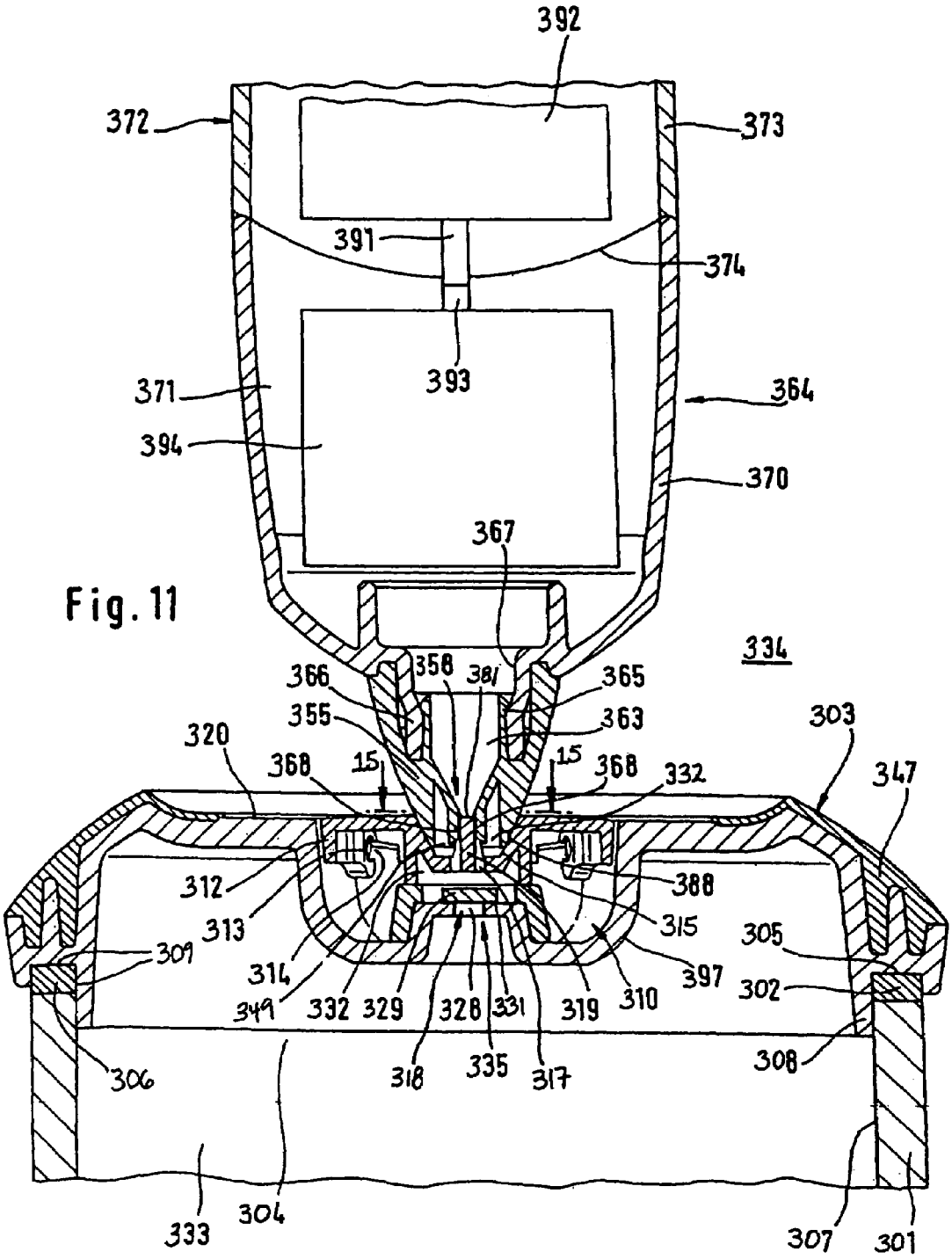
FIG. 11 is a cross-sectional view of an embodiment of a food storage container that is coupled to an embodiment of a device for evacuating a food storage container.

Referring to FIG. 11, a system 300 for evacuating a container closable by a cover includes a pot-shaped container 301 that has an essentially oval or circular cross-sectional shape and structure (although other cross-sectional shapes and structures are possible). Container 301 includes a lid/cover 303 that contacts an edge 302 of the container to close an opening 304 in the container. A sealing ring 306, which is located between edge 302 of container 301 and an edge 305 of lid 303, seals lid 303 such that lid 303 covers opening 304. For improved centering, lid 303 has a centering edge 308, which is centred on inner container wall 307.

Figure 16:
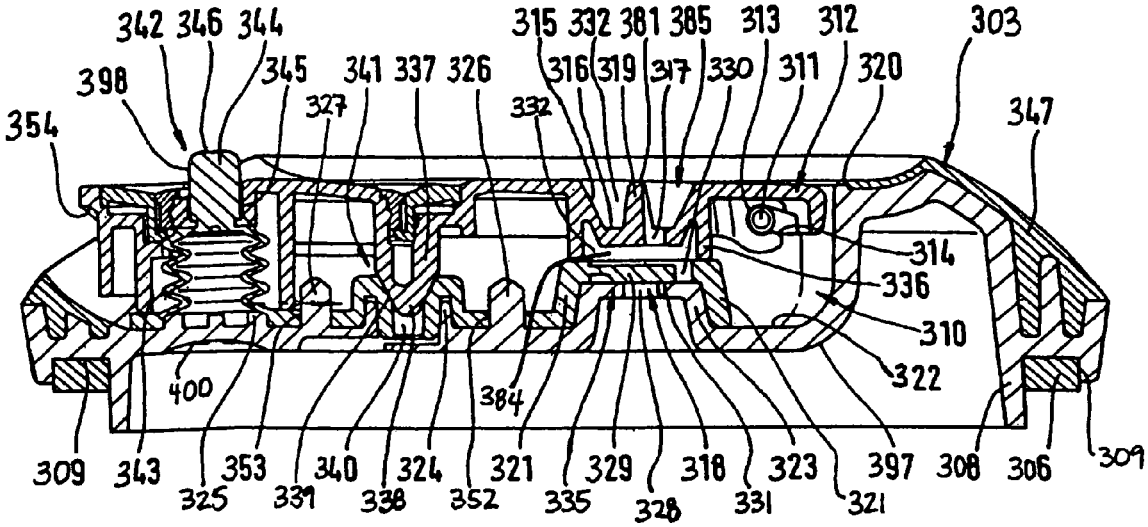
FIG. 16 is a cross-sectional side view of the container of FIG. 11.
Figure 18:
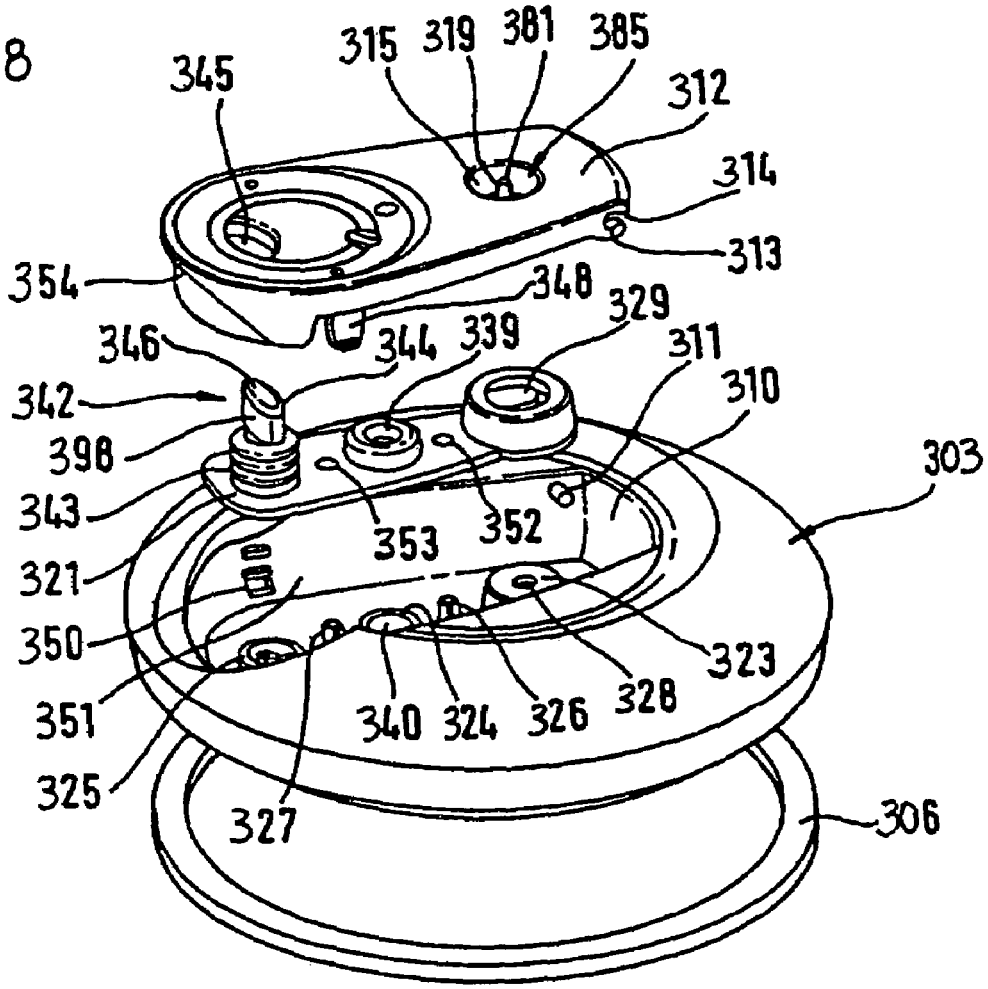
FIG. 18 is an exploded view of the container of FIG. 11.

Referring to both FIGS. 11 and 16, sealing ring 306 is inserted under prestress into a U-shaped ring groove 309, so that sealing ring 306 does not fall from lid 303. Referring now also to FIG. 18, lid 303 has an oval recess 310 running across its center. Two formed bearing journals 311, on which a valve cover 312 is positioned in an upwardly tiltable manner, are formed in recess 310, at the side walls of recess 310, diametrically opposed at the one corner. For this purpose, bearing bores 313, which are provided with slits 314 on the one side for disassembly, are formed in valve cover 312.

Valve cover 312 has a cover sealing surface 315, which tapers conically in a downward direction (forming a frustoconical recess). Cover sealing surface 315 includes a passage 317 that is laterally formed in the bottom surface 316 of cover sealing surface 315. Passage 317 forms the outlet of a flow channel 318 (i.e., a vent opening) of lid 303. A protrusion 319 (e.g., in the form of a pin or journal), which runs approximately to surface 320 of lid 303, extends concentrically to frustoconical cover sealing surface 315 from bottom surface 316.

Formed on the underside of valve cover 312, and concentrically disposed relative to cover sealing surface 315, is a collar 336, which presses a structured, planar, band-shaped sealing sleeve 321 against bottom 322 of oval recess 310 of lid 303. Bottom 322 is also structured like sealing sleeve 321, and has three ring-shaped elevations 323, 324, and 325, as well as two upwardly protruding pilot pins 326 and 327. Pilot pins 326 and 327 center sealing sleeve 321 and penetrate bores 352 and 353, which are formed in sealing sleeve 321. Elevation 323 includes a passage 328 in its center. Passage 328 is closed from above by a sealing tongue 329 formed in sealing sleeve 321. Sealing tongue 329 is separated from the rest of sealing sleeve 321 on one side by a slit 330, which runs in an essentially U-shaped manner. Sealing tongue 329 is connected to the rest of sealing sleeve 321 on the other side (at the bottom of the U). This ensures that sealing tongue 329 is able to lift the underside 397 of sealing surface 331 of non-return valve 335 (described further below) in the occurrence of a vacuum.

Passage 317, outlet 332, and passage 328 form flow channel 318 of lid 303. Flow channel 318 connects interior volume 333 of container 301 with atmosphere 334. Sealing tongue 329, along with sealing surface 331 and passage 328, forms non-return valve 335 of lid 303. When valve cover 312 is closed, collar 336 presses sealing sleeve 321 against the outer top edge of elevation 323, such that sealing sleeve 321 cannot lift away from elevation 323.

Furthermore, and as shown in FIG. 16, valve cover 312 has a sealing journal 337 that is aligned in a downward direction, with its pointed end 338 engaging with a conical recess 339 of sealing sleeve 321 to seal and thereby close ventilation channel 40. When pointed end 338 of sealing journal 337 is engaged with conical recess 339, sealing journal 337 is laterally disposed relative to non-return valve 335. The combination of sealing journal 337 and conical recess 339 forms a ventilation valve 341. When valve cover 312 is moved about both bearing journals 311 in a clockwise direction, a ventilation channel 340 is opened, and air from the outside is able to enter interior volume 333 of container 301. As a result, interior volume 333 of container 301 is no longer under vacuum. Prior to the ventilation process, when there is a vacuum in interior volume 333, sealing tongue 329 is pressed against sealing surface 331, such that non-return valve 335 is closed and may not be opened without intervention.

Figure 16A:
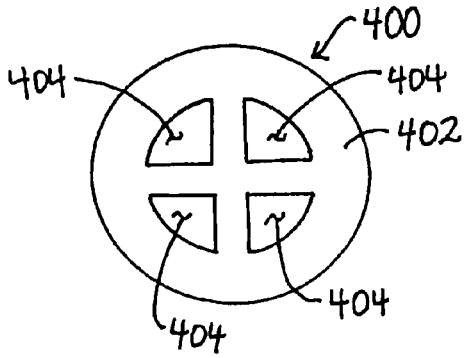
FIG. 16A is a top view of a vacuum sense opening of the container of FIGS. 11 and 16.

Ring-shaped elevation 325, which is disposed laterally relative to ventilation valve 341, is used as a guide for a pressure-indicating protrusion 342. Pressure-indicating protrusion 342 includes a bellows-like, one-piece diaphragm 343, which projects upward from sealing sleeve 321. Pressure-indicating protrusion 342 also includes a journal 344 at one end of diaphragm 343. Journal 344 extends through a bore 345 in valve cover 312, such that journal 344 is visible in valve cover 312. Pressure-indicating protrusion 342 is disposed over a vacuum sense opening 400, which is shown in greater detail in FIG. 16A, and which allows pressure-indicating protrusion 342 to be in fluid communication with interior volume 333 of container 301. In the illustrated embodiment, vacuum sense opening 400 is formed by four holes 404 through a generally ring-shaped member 402, which is integrally formed with lid 303.

When there is an insufficient vacuum in interior volume 333 of container 301, journal 344 is extended completely in an upward direction. However, as a sufficient vacuum in generated in interior volume 333 of container 301 (when lid 303 is placed on container 301), diaphragm 343 contracts due to the pressure conditions, and journal 344 travels in a downward direction into bore 345, such that diaphragm 343 is barely visible from the outside (i.e., only the top 346 of journal 344 is still visible). At this point, an operator now knows that the correct vacuum has been achieved within container 303.

In some embodiments, journal 344 can include one or more colors. Journal 344 can be, for example, red. In certain embodiments, journal 344 can have a different color from the rest of container 301. Being colored can allow journal 344, when it is extended in an outward direction, to be relatively easily recognized on its peripheral side 398 and its top 346. Thus, pressure-indicating protrusion 342 may even more effectively signal to an operator that the vacuum in interior volume 333 of container 301 is no longer sufficient to store food for a relatively long period of time. Furthermore, in some instances, pressure-indicating protrusion 342 can acoustically signal to an operator that the pressure level within container 301 is no longer sufficient (e.g., by "popping out" and extending in an upward direction).

Referring especially now to FIGS. 11 and 16, a soft elastomer (preferably a plastic) is sprayed onto surface 320 of lid 303. The soft elastomer gives lid 303 a soft outer protective skin 347 that can, for example, allow lid 303 to be handled in a more secure manner, and that can give lid 303 enhanced protection against damage. Alternatively or additionally, protective skin 347 can make it easier for visual design features (e.g., a manufacturer logo) to be configured in lid 303.

FIG. 18 shows laterally snap fingers 348, which extend downwardly from valve cover 312, and are disposed toward a side of the lid 303 opposite the side from which the lid 303 is lifted upward. As valve cover 312 is closed, snap fingers 348 snap into lateral cut-outs 350 of side wall 351 of recess 310 in lid 303. When snap fingers 348 snap into lateral cut-outs 350, they press sealing sleeve 321 (via collar 336 and sealing journal 337) against the bottom of recess 310. To open valve cover 312, an operator can use one finger to reach under a grip edge 354, which is located on the same side of container 301 as snap fingers 348, and tilt valve cover 312 in an upward direction about bearing journals 311.

Referring to FIG. 11, a conical connector 355 of a container evacuation pump 364 is sealingly inserted into cover sealing surface 315 of valve cover 312. Connector 355 includes a connector control valve 358 (shown as a flapper valve) that includes unilateral, partially ring-shaped segments 356 and 357. When connector 355 is inserted into cover sealing surface 315, the free end of protrusion 319 extends into segments 356 and 357 of connector control valve 358, pressing both tongues 359 and 360 of connector control valve 358 apart. As a result, side passages 361 and 362 (shown in FIG. 15) are created, thereby opening a suction channel 363 of connector 355 that is in fluid communication with passage 317 and flow channel 318.

Figure 12:
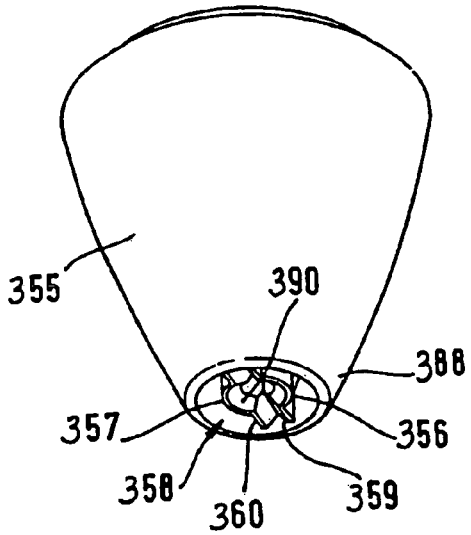
FIG. 12 is a perspective view of a connector of the device of FIG. 11.
Figure 13:
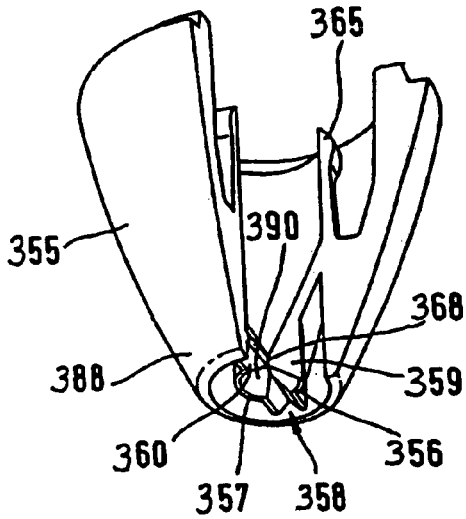
FIG. 13 is a cutaway view of the connector of FIG. 12.
Figure 15:
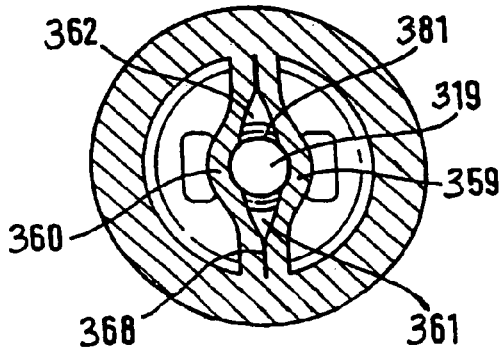
FIG. 15 is a bottom view of the coupling of the connector of FIGS. 12 and 13 with the protrusion of FIG. 14, taken along line 15—15 in FIG. 11.

FIGS. 12 and 13 show connector 355 in greater detail. Connector 355 is made of an elastomeric plastic that allows connector 355 to seal effectively. Connector 355 is fixedly clipped onto the free end of housing 370 of container evacuation pump 364 (FIG. 11). Elastic locking elements 365, which are formed on the inner wall of connector 355, lock (as a friction-fit) into recesses 367, which are formed on a tube-shaped connecting piece 366 of housing 370. Thus, locking elements 365 firmly connect connector 355 with housing 370 of container evacuation pump 364. Opposing tongues 359 and 360 extend from the inner wall of connector 355 and form connector control valve 358 (FIG. 15). When connector control valve 358 is closed, tongues 359 and 360 are pressed against one another at their sealing surfaces 368, such that side passages 361 and 362 are closed in a pressure-tight manner.

Figure 14:
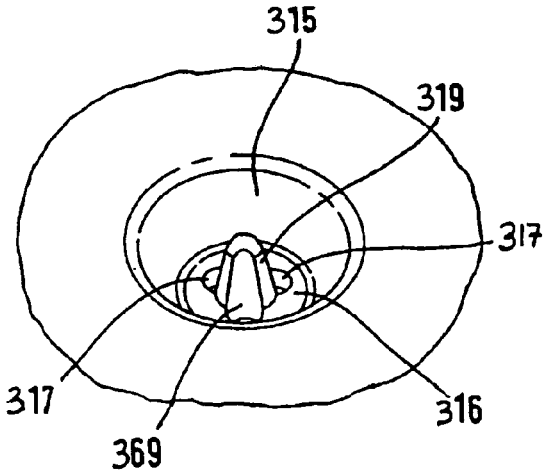
FIG. 14 is a top view of a protrusion of the container of FIG. 11.

As shown in FIG. 14, protrusion 319 has grooves 369 on its outer periphery that run in the longitudinal direction of protrusion 319. As shown in FIG. 15, grooves 369 provide for improved passage when connector control valve 358 is opened. In this context, both sealing surfaces 368 are separated from one another, and side passages 361 and 362 are formed.

FIG. 11 shows a partial illustration of housing 370 of container evacuation pump 364 and housing 373 of an electric drive unit 372. Housings 370 and 373 are attached to each other. Boundary 374 shows the transition from housing 370 to housing 373. Housings 370 and 373 house a rotor pump unit 394, an electric motor 392, and drive shafts 391 and 393. Connector 355 is attached to housing 370. The design of container evacuation pump 364, which is not shown in the figures, includes lamina that are formed on a rotor and a laminated housing, as well as a valve device for regulating pressure. However, other container evacuation pumps can be used here, such as those described in U.S. Pat. No. 5,195,427 and in German Patent No. DE 100 60 996 C1, both of which are herein incorporated by reference. Rotor pump unit 394 of container evacuation pump 364 is formed in a space 371 surrounded by housing 370. In FIG. 11, drive unit 372 and housing 373 both are shown only in part. Drive unit 372 includes electric motor 392 and drive shaft 391, which is coupled to drive shaft 393 of container evacuation pump 364.

Figure 17:
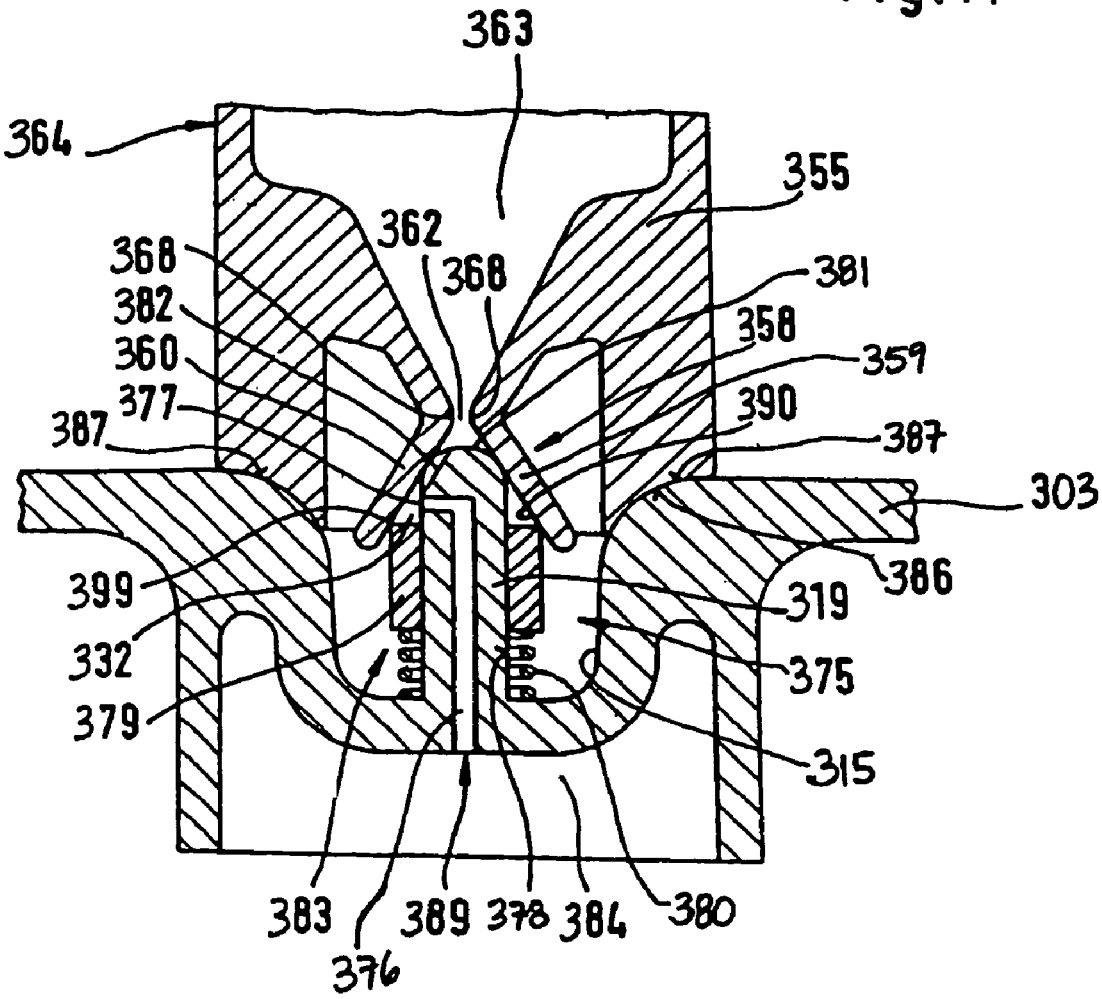
FIG. 17 is a cross-sectional side view of an embodiment of a portion of a food storage container coupling with the connector of FIGS. 12 and 13.

FIG. 17 shows an embodiment of a valve arrangement 375. In FIG. 17, as was the case with FIG. 11, connector control valve 358 is a part of connector 355 of container evacuation pump 364. However, one difference between FIG. 11 and FIG. 17 is that in FIG. 17, protrusion 319 is in the form of a cylinder that has a central bore 376. Bore 376 forms a channel through the center of protrusion 319. Bore 376 exits protrusion 319 laterally at the free end of protrusion 319, forming an outlet 377. A bushing 379 is guided precisely over outer surface 378 of protrusion 319 and can glide over outer surface 378. Bushing 379 is disposed over a spring 380. When connector 355 of container evacuation pump 364 is lifted away from lid 303, spring 380 causes bushing 379 to move, and to thereby close outlet 377 of bore 376.

The free end of protrusion 319 forms a stop surface 381 for connector control valve 358. The free end of protrusion 319 includes a slit 382 that opens a flow path between suction channel 363 and bore 376 when connector 355 is coupled with protrusion 319 (as shown in FIG. 17). As shown, the location of slit 382 is restricted to only a portion of the free end of protrusion 319. Thus, to form side passage 362 (FIG. 15), connector 355 should be pressed against protrusion 319 (or vice versa) to sufficiently separate tongues 359 and 360 of connector 355 from each other. Side passage 362 allows for fluid communication in an upward direction between bore 376 and suction channel 363 of container evacuation pump 364. Movable bushing 379, together with bore 376 and protrusion 319, forms a protrusion control valve 383.

When connector 355 is placed on and pressed against valve arrangement 375, a flow channel 389 is formed. Flow channel 389 includes suction channel 363 of connector 355, side passage 362, slit 382, outlet 377, bore 376, and a channel segment 384 (which is directly under protrusion 319). At its free end, connector 355 includes a sealing surface 386. As noted above, valve cover 312 has a cover sealing surface 315. At its top outlet, cover sealing surface 315 includes a peripheral sealing surface 387, which is used as a pressure-tight contact surface for sealing surface 386 of connector 355. In this context, both peripheral sealing surface 387 and sealing surface 386 are formed in a ring-shaped manner, such that they are flush when they contact each other.

As shown in FIG. 17, tongues 359 and 360 of connector 355 are pressed sufficiently far apart as to open side passage 362 (as was also the case in FIG. 15). At the same time, operating surface 390, formed on the inner surface of tongue 360, pushes bushing 379 in a downward direction via a ring-shaped corner 399 on bushing 379, such that outlet 377 is opened.

The operation of the above-described container evacuation systems and corresponding vacuum pumps is described below with reference to FIG. 11.

As long as container evacuation pump 364 (including its drive unit 372) is not placed on non-return 335, lid 303 may be removed from or placed on container 301. However, if, for example, container 301 is closed by lid 303 after interior volume 333 of container 301 has been filled with food, then the system may be evacuated. For this purpose, connector 355 is inserted into outlet 385 of lid 303 (shown in FIG. 16) until sealing surface 388 of connector 355 (shown in FIGS. 12 and 13) contacts cover sealing surface 315 in a sealing manner. In this context, protrusion 319 engages with partially ring-shaped segments 356 and 357 of tongues 359 and 360, and presses tongues 359 and 360 apart, such that sealing surfaces 368 of tongues 359 and 360 are partially separated from each other, thereby forming side passages 361 and 362. In this position, non-return valve 335 is still closed, since there is atmospheric air in interior volume 333 of container 301, as well as outside of container 301.

When drive unit 372 is activated by an electric circuit (not shown), drive shaft 391 of electric motor 392 rotates, driving drive shaft 393 of rotor pump unit 394. Rotor pump unit 394 promotes a vacuum, in that rotor pump unit 394 attempts to suction air out of interior volume 333 of container 301. As soon as the pressure above the non-return valve 335 has sufficiently decreased (as a result of the resulting vacuum in suction channel 363), non-return valve 335 opens (i.e., sealing tongue 329 lifts away from sealing surface 331). Once non-return valve 335 has opened, air flows from interior volume 333 of container 301, through flow channel 318 of lid 303 (which is formed by passage 328, outlet 332, passage 317, side passages 361 and 362, and suction channel 363), to container evacuation pump 364, where the air is pumped into atmosphere 334. This process is maintained until a predefined vacuum results in interior volume 333 of container 301. As soon as a predefined vacuum has been reached in interior volume 333, a control valve (not shown) formed in container evacuation pump 364 opens to keep the pressure in interior volume 333 constant.

A pressure display device formed on container evacuation pump 364 can be used to show an operator that the predetermined pressure has been reached within interior volume 333 of container 301, thereby notifying the operator that container evacuation pump 364 can be deactivated and removed from non-return valve 335. As soon as container evacuation pump 364 is deactivated, non-return valve 335 closes, thereby closing flow channel 318 of lid 303 with respect to atmosphere 334. The operator can then remove connector 355, complete with container evacuation pump 364 and connected drive unit 372, from lid 303, without the air from atmosphere 334 being able to penetrate interior volume 333 of container 301. The air from atmosphere 334 also cannot penetrate interior volume 333 because ventilation valve 341 is securely closed. Furthermore, lid 303 and sealing ring 306 are firmly and sealingly pressed against edge 302 of container 301, as a result of the vacuum force formed in interior volume 333 of container 301.

During the evacuation procedure, diaphragm 343 contracts, such that journal 344 glides into bore 345. Thus, only the top 346 of journal 344 is still visible from above. This also indicates to an operator that the correct pressure has been reached in interior volume 333 of container 301. Food may now be stored in this manner under a predetermined vacuum for a relatively long period of time.

When connector 355 is removed from non-return valve 335, protrusion 319 slides out of operating surface 390, so that connector control valve 358 closes again (i.e., sealing surfaces 368 return to having a common contact surface, such that they are flush with each other).

To remove food from interior volume 333 of container 301, an operator can reach with, for example, a finger or a thumb, under grip edge 354, and tilt valve cover 312 in a clockwise direction about bearing journals 311, until pointed end 338 of sealing journal 337 lifts away from the sealing surface of conical recess 339. When this happens, atmospheric air flows into interior volume 333 of container 301 via ventilation channel 340. In some embodiments, the entrance of atmospheric air into interior volume 333 results in the development of hissing noises. The operator may only have to exert a relatively low force to open valve cover 312, as a result of the lever-like configuration and the relatively small sealing surface. Once atmospheric air is again within interior volume 333 of container 301, lid 303 may be removed from container 301 without exerting substantial force, since there is no longer a substantial closing force between sealing ring 306 and edge 302 of container 301.

The primary difference between the operation of valve arrangement 375 (FIG. 17) and the operation of valve arrangement 349 (FIG. 11) is in the positioning of connector 355. In the case of both valve arrangements, when connector 355 is positioned, protrusion 319 opens connector control valve 358. In the case of valve arrangement 375, ring-shaped corner 399 on bushing 379 is simultaneously pushed down against the force of spring 380 as a result of operating surfaces 390, which are formed on tongues 359 and 360. The pushing down of bushing 379 causes bushing 379 to move, thereby opening outlet 377 so that hydraulic communication is established between flow channel 389 and suction channel 363, and air can be withdrawn from interior volume 333 of container 301, which is located below channel segment 384 in FIG. 17. When connector 355 is later removed from valve arrangement 375, the procedure as described above is simply executed in reverse.

Container evacuation pumps are further described, for example, in a jointly owned patent application filed concurrently herewith, Vilalta et al., U.S. patent application Ser. No. 10/882,551, entitled "Food Storage Containers", which is hereby incorporated by reference in its entirety.

A number of embodiments of the invention have been described. Nevertheless, it will be understood that various modifications may be made without departing from the spirit and scope of the invention. Accordingly, other embodiments are within the scope of the following claims.

What is claimed is:

1. A lid for a food storage container, the lid comprising:

a lid body defining a vacuum sense opening and a vent opening extending through the lid body;

a releasable cover disposed over the vent opening to impede air flow into the container through the vent opening until the cover is released, while enabling evacuation of the container through the vent opening before the cover is released, the cover defining an indicator opening; and a pressure-indicating protrusion in hydraulic communication with the container through the vacuum sense opening and defining a cavity therein, wherein the pressure-indicating protrusion contracts toward the vacuum sense opening in response to negative container pressure.

2. The lid of claim 1, wherein the pressure-indicating protrusion comprises a bellows that is sealed at one end by a pressure-indicating plug.

3. The lid of claim 1, wherein the pressure-indicating protrusion comprises a membrane.

4. The lid of claim 3, wherein the membrane is pleated.

5. The lid of claim 4, wherein the pressure-indicating protrusion further comprises a pressure-indicating plug at one end of the membrane.

6. The lid of claim 5, wherein the cover defines an indicator opening and wherein the pressure-indicating plug, under certain container pressure conditions, extends through the indicator opening.

7. The lid of claim 5, wherein the pressure-indicating plug is of a different color from the cover.

8. The lid of claim 3, wherein the membrane collapses toward the vacuum sense opening in response to negative container pressure.

9. The lid of claim 3, wherein the membrane folds toward the vacuum sense opening in response to negative container pressure.

10. The lid of claim 3, further comprising a resilient layer in contact with the membrane.

11. The lid of claim 10, wherein the resilient layer comprises a spring sheet.

12. The lid of claim 10, wherein the resilient layer comprises an elastomeric polymer.

13. The lid of claim 3, wherein the cover defines an indicator opening, and wherein the membrane, under certain container pressure conditions, extends through the indicator opening.

14. The lid of claim 3, wherein the membrane is formed of a plastic resin.

15. The lid of claim 14, wherein the plastic resin is selected to maintain dimensional stability of the membrane over a temperature range between −40° C. and 100° C.

16. The lid of claim 1, further comprising a one-way valve.

17. The lid of claim 16, wherein the one-way valve comprises a movable sealing tab.

18. The lid of claim 17, wherein the pressure-indicating protrusion is integrally connected with the sealing tab.

19. The lid of claim 1, wherein the cover is pivotably connected to the lid body by a hinge.

20. The lid of claim 1, wherein the pressure-indicating protrusion comprises a spring.

21. The lid of claim 1, wherein the pressure-indicating protrusion comprises a resilient material.

22. A lid for a food storage container, the lid comprising:

a lid body defining a vent opening therethrough;

a releasable cover disposed over the vent opening to impede air flow into the container through the vent opening until the cover is released, the releasable cover defining an evacuation opening and having a gripping surface for manually releasing the cover;

a membrane that covers the vent opening until the cover is released; and a driving element connected to the membrane at one end and disposed within the evacuation opening at another end, the driving element being configured to lift the membrane from the vent opening when the cover is released.

23. The lid of claim 22, wherein the membrane comprises an elastomeric plastic.

24. The lid of claim 22, wherein the membrane is a one-way valve.

25. The lid of claim 22, wherein the driving element defines a rim.

26. The lid of claim 22, wherein the driving element is integrally connected to the membrane.

27. The lid of claim 22, wherein the cover defines a surface extending about the evacuation opening and adapted to receive a sealing lip of a vacuum pump.

28. The lid of claim 22, wherein the lid body comprises a plastic resin selected to maintain dimensional stability of the membrane over a temperature range of between −40° C. and 100° C.

29. A lid for a food storage container, the lid comprising:

a lid body defining, spaced apart and extending parallel through the lid body, a vacuum sense opening, a ventilation channel, and a vent opening;

a releasable cover disposed over the ventilation channel to impede air flow into the container through the ventilation channel until the cover is released, while enabling evacuation of the container through the vent opening before the cover is released, the cover defining an indicator opening; and a pressure-indicating protrusion in hydraulic communication with the container through the vacuum sense opening and defining a cavity therein, wherein the pressure-indicating protrusion contracts toward the vacuum sense opening in response to negative container pressure.

30. The lid of claim 29, wherein the pressure-indicating protrusion comprises a bellows that is sealed at one end by a pressure-indicating plug.

31. The lid of claim 29, wherein the pressure-indicating protrusion comprises a membrane.

32. The lid of claim 31, wherein the membrane is pleated.

33. The lid of claim 32, wherein the pressure-indicating protrusion further comprises a pressure-indicating plug at one end of the membrane.

34. The lid of claim 33, wherein the pressure-indicating plug, under certain container pressure conditions, extends through the indicator opening.

35. The lid of claim 33, wherein the pressure-indicating plug is of a different color from the cover.

36. The lid of claim 31, wherein the membrane collapses toward the vacuum sense opening in response to negative container pressure.

37. The lid of claim 31, wherein the membrane folds toward the vacuum sense opening in response to negative container pressure.

38. The lid of claim 31, wherein the membrane, under certain container pressure conditions, extends through the indicator opening.

* * * * *